US009554956B2

(12) United States Patent
Reiners et al.

(10) Patent No.: US 9,554,956 B2
(45) Date of Patent: Jan. 31, 2017

(54) PATIENT TURNING AND POSITIONING SYSTEM DEVICE

(71) Applicant: Vision of Labor, LLC, Tucson, AZ (US)

(72) Inventors: Anne Marie Reiners, Tucson, AZ (US); Rebecca Lee Kujawa, Tucson, AZ (US)

(73) Assignee: Vision of Labor, LLC, Tucson, AZ (US)

( * ) Notice: Subject to any disclaimer, the term of this patent is extended or adjusted under 35 U.S.C. 154(b) by 289 days.

(21) Appl. No.: 14/508,718

(22) Filed: Oct. 7, 2014

(65) Prior Publication Data

US 2015/0101126 A1 Apr. 16, 2015

Related U.S. Application Data

(60) Provisional application No. 61/889,042, filed on Oct. 10, 2013.

(51) Int. Cl.
*A61G 7/00* (2006.01)
*A61G 7/10* (2006.01)

(52) U.S. Cl.
CPC ..... *A61G 7/001* (2013.01); *A61G 7/1026* (2013.01); *A61G 7/1028* (2013.01)

(58) Field of Classification Search
CPC ..... A61G 7/00
USPC ..... 5/710, 713, 715, 644, 648
See application file for complete search history.

(56) References Cited

U.S. PATENT DOCUMENTS

| | | | | |
|---|---|---|---|---|
| 3,477,071 | A | 11/1969 | Emerson | |
| 3,485,240 | A | 12/1969 | Fountain | |
| 3,775,781 | A | 12/1973 | Bruno | |
| 4,962,552 | A | 10/1990 | Hasty | |
| 5,067,189 | A | 11/1991 | Weedling | |
| 5,073,999 | A | 12/1991 | Thomas | |
| 5,092,007 | A | 3/1992 | Hasty | |
| 5,121,512 | A | 6/1992 | Kauffman | |
| 5,168,589 | A | 12/1992 | Stroh | |
| 5,375,273 | A | 12/1994 | Bodine | |
| 5,794,289 | A * | 8/1998 | Wortman | A61G 7/001 5/423 |
| 6,073,291 | A | 6/2000 | Davis | |
| 6,154,900 | A | 12/2000 | Shaw | |
| 6,327,724 | B1 | 12/2001 | Sharrock | |
| 6,370,716 | B1 * | 4/2002 | Wilkinson | A61G 5/1043 297/314 |

(Continued)

FOREIGN PATENT DOCUMENTS

| | | | |
|---|---|---|---|
| CA | 2809124 | A1 | 5/2002 |
| EP | 0913138 | A1 | 5/1999 |

*Primary Examiner* — Fredrick Conley
(74) *Attorney, Agent, or Firm* — Eugene Vamos

(57) ABSTRACT

The invention comprises of a device that allows health care providers to position the body of a patient for progression of labor, for assistance in fetal resuscitation, and for other medical procedures. The device has inflatable chambers that assist the labor and delivery health care provider in turning a patient onto her right or left side while laying in bed. An inflatable positioning pad is used to further assist with the turning of a patient and/or with the shifting of a patient toward the head or the foot of the bed as needed. This device and method will allow turning to be done frequently, rapidly and safely, especially in pregnant patients with epidurals, that are overweight, or that otherwise have difficulty moving on their own.

53 Claims, 23 Drawing Sheets

(56) References Cited

U.S. PATENT DOCUMENTS

| | | | | |
|---|---|---|---|---|
| 7,007,330 | B2 | 3/2006 | Kuiper | |
| 2002/0133877 | A1 | 9/2002 | Kuiper | |
| 2007/0006388 | A1* | 1/2007 | Townsend | A61G 7/001 5/715 |
| 2007/0143928 | A1* | 6/2007 | Biggie | A61G 7/001 5/715 |
| 2014/0007353 | A1* | 1/2014 | Stryker | A61G 7/001 5/715 |

* cited by examiner

PATIENT TURNING AND POSITIONING SYSTEM DEVICE

CROSS-REFERENCE TO RELATED APPLICATIONS

This application claims the priority benefit of U.S. Provisional Patent Application Ser. No. 61/889,042 filed Oct. 10, 2013.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

REFERENCE TO A "SEQUENCE LISTING," A TABLE, OR A COMPUTER PROGRAM LISTING COMPACT DISK APPENDIX

Not Applicable

BACKGROUND OF THE INVENTION

(1) Field of the Invention

The invention is a device that assists a healthcare provider to turn a bedridden patient from her left side to her right side and vice versa, to shift a patient from one part of the bed to another part of the bed or to keep a patient inclined. The device comprises of a turning pad with two inflatable chambers, finable with a gas which is usually air. An inflatable positioning pad is placed between a patient and the turning pad. This inflatable positioning pad is used to aid with the turning of a bedridden patient and with the shifting of a bedridden patient from one part of the bed to another to another part of the bed. The inflation of the turning pad and the inflatable positioning pad is aided by air hoses and an air-supply system. Various methods are described that use the device to turn a bed ridden patient from her left side to her right side and vice versa.

(2) Description of the Related Art

As a woman ("patient") goes through the labor process, the patient needs to be placed on her side and to be re-positioned to her other side throughout the labor process for medical and comfort reasons by labor and delivery health care providers ("labor nurses").

A pregnant patient needs to be tilted or wedged onto her right or left side ("lateral position") to displace the uterus to the side. To keep patients in a lateral position, labor nurses currently use foam wedge pillows. This positioning keeps the uterus from compressing the vena cava and causing a disruption in a patient's circulatory system. This disruption can cause a patient's blood pressure to drop and to decrease the amount of blood flow going to the uterus, the placenta and the baby. The result is either a repetitive or sustained deceleration in the fetal heart rate. To introduce a wedge under a patient, the labor nurse a) pulls on what is under the patient, moving the patient to the edge of the bed, b) rolls the patient in the opposite direction to a lateral position, and c) shoves the wedge under the patient. However, there are many deficiencies with this current turning method. The foam wedge often gets pushed off the bed or is completely flattened due to a patient's size. When a patient is large and/or heavy, the wedge is ineffective in keeping a patient in a lateral position.

Wedges are also utilized when patients give birth by Cesarean section. For instance, when a woman gives birth by Cesarean section, she lies on the surgical table with her right hip tilted up by a rolled up towel or soaker pad, which displaces the uterus to the side. This positioning keeps the uterus from compressing the vena cava and causing a disruption in a patient's circulatory system during the Cesarean section. This disruption can cause a patient's blood pressure to drop and to decrease the amount of blood flow going to the uterus, the placenta, and the baby. The result is either a repetitive or sustained deceleration in the fetal heart rate. Once the Cesarean section is complete and a patient gives birth, the labor nurse reaches under the sterile field to remove the wedge. When a patient is large and/or heavy, the wedge is ineffective for keeping the patient in a lateral position, and it is hard to place prior to the Cesarean section and to remove after the patient gives birth.

Turning is the process of placing a patient from one lateral position to the other lateral position. Shifting is the process of moving a patient from one part of a bed to another part of the bed. A patient is in right lateral position when the left side of her body is tilted up and the right side of her body leans against a surface. A patient is in left lateral position when the right side of her body is tilted up and the left side of her body leans against a surface. For example, a patient laying on a right lateral position is turned when she is moved to lie on a left lateral position. When a woman in labor is found to have a fetal heart rate tracing requiring fetal resuscitation, labor nurses are required to place a patient onto her right or left side utilizing a regular hospital sheet, soaker pad, what ever is under the patient, or by grabbing the patient and trying to pull her. Often the procedure is complicated because a patient is overweight, has an epidural, or both. To proceed with fetal resuscitation, a patient is quickly turned from one lateral position to the other lateral position and vice versa, several times until the fetal heart tones return to normal. Based on the medical condition, a patient may need to be turned five or six times in a 60 second period; hence, fast turning is required for efficacious medical treatment. Furthermore, in a normal labor process, laboring patients are encouraged to turn at least every 30 minutes to assist with the labor process; patients require nursing assistance if they have an epidural or are overweight.

Labor nurse injuries and equipment dislodgment occur frequently when utilizing current turning methods. Labor nurses are almost always at a patient's bedside alone. If an emergency arises, the labor nurse will usually be the first person changing a patient's position. Injury to labor nurses occur when they reposition patients; nurses can injure themselves by attending to an emergency event or by simply changing a patient's position in the course of normal labor. Epidural catheters can be dislodged from the epidural space due to the pulling on a patient's skin by the friction caused from quickly turning and shifting patients. If the epidural catheter is moved out of the correct position, the epidural will not work. An epidural catheter can also be dislodged or broken at the point where the catheter is connected to its base feeding adapter if there is a lack of a strain release mechanism. This kind of displacement can be caused with the applied amount of force and the awkward motion resulting from the current turning methods.

Prior art patient turning devices contemplate rotating a patient in place, such as U.S. Pat. No. 3,775,781 (Bruno), U.S. Pat. No. 7,007,330 (Kuiper), and U.S. Pat. No. 6,154,900 (Shaw). These devices by themselves, have no means to shift a patient within the bed. Specifically, these devices do not contemplate shifting a patient from one side of the bed to another side of the bed while turning the patient from one side to the other. This shifting is desired to adjust the turning angle of the patient as they lay over the turning device, for better comfort of the patient, and for more efficacious and faster repositioning of the patient.

This shifting of a patient within a bed surface requires significant effort in the part of the labor nurses, primarily due to the friction caused between a patient and the supporting bed. Labor nurses traditionally use their arms, bed sheets, or soaker pads to move around patients. However, these means still create a significant amount of friction that requires significant effort in the part of the labor nurses and creates patient discomfort.

Prior art patient turning devices do not contemplate efficient and simple manners to rapidly deflate air chambers to accommodate medical emergencies that require rapid turning of a patient either as a single event or part of a cycle of turning. U.S. Pat. No. 3,775,781 (Bruno) uses solenoid valves within the air-supply housing to deflate air chambers. U.S. Pat. No. 7,007,330 (Kuiper) uses quick release valves and solenoid valves to deflate bladders. U.S. Pat. No. 6,154,900 (Shaw) does not teach any particular deflation methods. U.S. Pat. No. 4,962,552 (Hasty) describes devices that use air permeable materials or holes in low air flow configurations where the flow of air is gradual and the rotation of patients is gradual rather than rapid.

The use of turning devices necessitates the cleaning and repairing of some or all of the components of the turning devices. Components that are directly in contact with a patient get soiled and need to be removed to be laundered. A number of prior art patient turning devices do not contemplate components being able to be parted out for individual laundering and repair, such as U.S. Pat. No. 3,775,781 (Bruno) and U.S. Pat. No. 3,485,240 (Fountain). Although U.S. Pat. No. 6,073,291 (Davis) does allow for the removal of bladder components through the use of a sleeve, it does not solve many of the prior problems with patient turning devices: it does not teach any particular deflation method, it does not provide for shifting of a patient and it does not help minimize the effort expended by nurses if a patient needs to be shifted. Furthermore, the turning device is bounded by the requirement that there be partially overlapping bladders, which limits the manner a patient can be turned and shifted around the bed. Although U.S. Pat. No. 7,007,330 (Kuiper) does allow for the removal of bladder components through the use of a sleeve, it does not provide for rapid shifting of a patient, it does not help minimize the effort expended by nurses if a patient needs to be shifted around a bed, does not allow for a means to adjust and reposition a patient and does not allow for a simple fast manner to deflate air chambers.

BRIEF SUMMARY OF THE INVENTION

This invention provides for a device ("the turning device") and method to maintain a patient (108) in a lateral position, to turn a patient (108) and to shift a patient (108). The invention comprises a turning pad (100), an inflatable positioning pad (102), air-supply hoses (104), and an air-supply system (106).

There are number of uses for this turning device. The turning device can be used with obstetrical patients, bariatric patients, and bed-ridden patients. This list only illustrates examples and is not exclusive in scope.

The turning pad (100) comprises of a left inflatable chamber (20), a right inflatable chamber (22) and a base pad (23). The left inflatable chamber (20) and right inflatable chamber (22) are able to be inflated. The base pad (23) comprises a base sheet (24). The inflatable positioning pad (102) may have one or more handles (30) located by the inflatable positioning pad's (102) sides. This enhanced grasp would allow for easier patient turning and repositioning. Air-supply hoses (104) allow for air-delivery from the air-supply system (106) to the turning pad (100) and the inflatable positioning pad (102). The turning pad (100) and the inflatable positioning pad (102) are made of a fabric that is semi air-permeable.

In another embodiment of the turning device, the base pad (23) comprises of a base sheet (24), a left securing sleeve (25), and a right securing sleeve (26). The left inflatable chamber (20) is inserted within the left securing sleeve (25) and the right inflatable chamber (22) is inserted within the right securing sleeve (26). This embodiment allows the base pad (23) to be separated from the inflatable chambers (20, 22) for easier laundering and repair.

In another embodiment of the turning device, manifolds are attached to the base pad (23), connecting the inflatable chambers to the air-hoses (104). This embodiment minimizes entanglement when a patient (108) is being turned or shifted.

BRIEF DESCRIPTION OF THE SEVERAL VIEWS OF THE DRAWING

FIG. 3 shows the relative locations of the turning pad (100): a head end (28), a foot end (29), a left side (62), a right side (63), a center line (64).

FIG. 8 also shows a perspective inside view of the right inflatable chamber (22) showing the support structures (27*b*) needed to hold the shape of the right inflatable chamber (22) while the right inflatable chamber (22) is inflated. The left inflatable chamber (20) and the right inflatable chamber (22) are shown in a double trapezoid wedge shape.

FIG. 23 also shows a right air-release valve (49) and a right chamber connector (45) attached to the right inflatable chamber (22). FIG. 23 shows the second end of the right chamber air-hose (161) connected to the right chamber connector (45) and the second end of the left chamber air-hose (163) connected to the left chamber connector (46). The left chamber connector (46) is connected at the foot end of the left inflatable chamber (20) and the right chamber connector (45) is connected at the foot end of the right inflatable chamber (22).

FIG. 25 shows a sectional view of the turning pad (100) of FIG. 26 taken at the sectioning place and in the direction indicated by section lines 26-26, showing the left inflatable chamber (20) and the right inflatable chamber (22), fastened to a base pad (23), as viewed from the foot end of the turning pad (29). The left inflatable chamber (20) and the right inflatable chamber (22) meet at the center line of the turning pad (64).

DETAILED DESCRIPTION OF THE INVENTION

Figure 1:
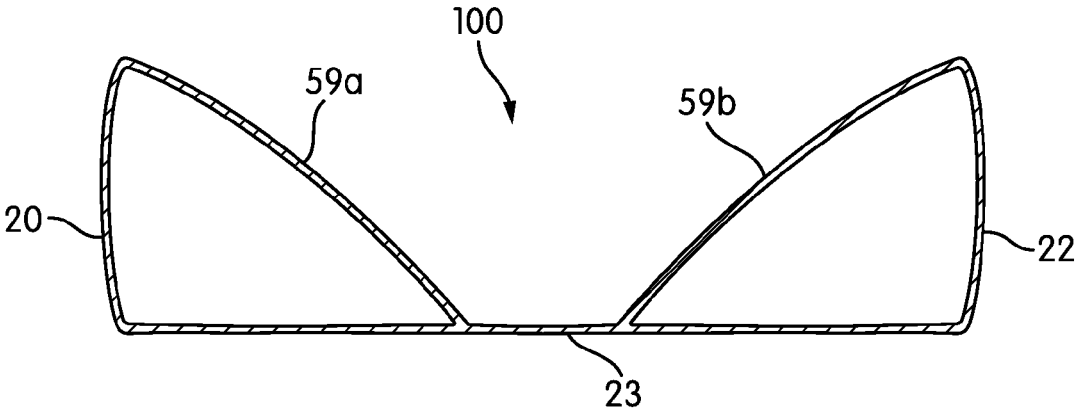
FIG. 1 shows a sectional view of the turning pad (100) of FIG. 3 taken at the sectioning place and in the direction indicated by section lines 1-1, showing the left inflatable chamber (20), the right inflatable chamber (22), fastened to a base pad (23), sharing a common surface, as viewed from the foot end of the turning pad (29). The left inflatable chamber (20) and the right inflatable chamber (22) are shown inflated.

(1) Detailed Description of the Turning Device

This invention provides for a device ("turning device") and method to maintain a patient (108) in a lateral position, to turn a patient (108) and to shift a patient (108). The invention comprises a turning pad (100), an inflatable positioning pad (102), air-supply hoses (104), and an air-supply system (106).

The turning pad (100) comprises a left inflatable chamber (20), a right inflatable chamber (22), and a base pad (23). The left inflatable chamber (20) and the right inflatable chamber (22), when inflated, form a volume that has at least one surface that supports patients lying on their side ("support surface"). Utilizing an inflatable chamber with a slanted surface as the support surface is preferable as it allows for positioning a patient (108) over the slanted surface of the volume, allowing a patient (108) to lie on her side with comfort. Examples of volumes that have such slanted surfaces include wedges and trapezoidal prisms. Examples of volumes that have do not have such a slanted surface include rectangular prisms and cylinders.

Figure 6:
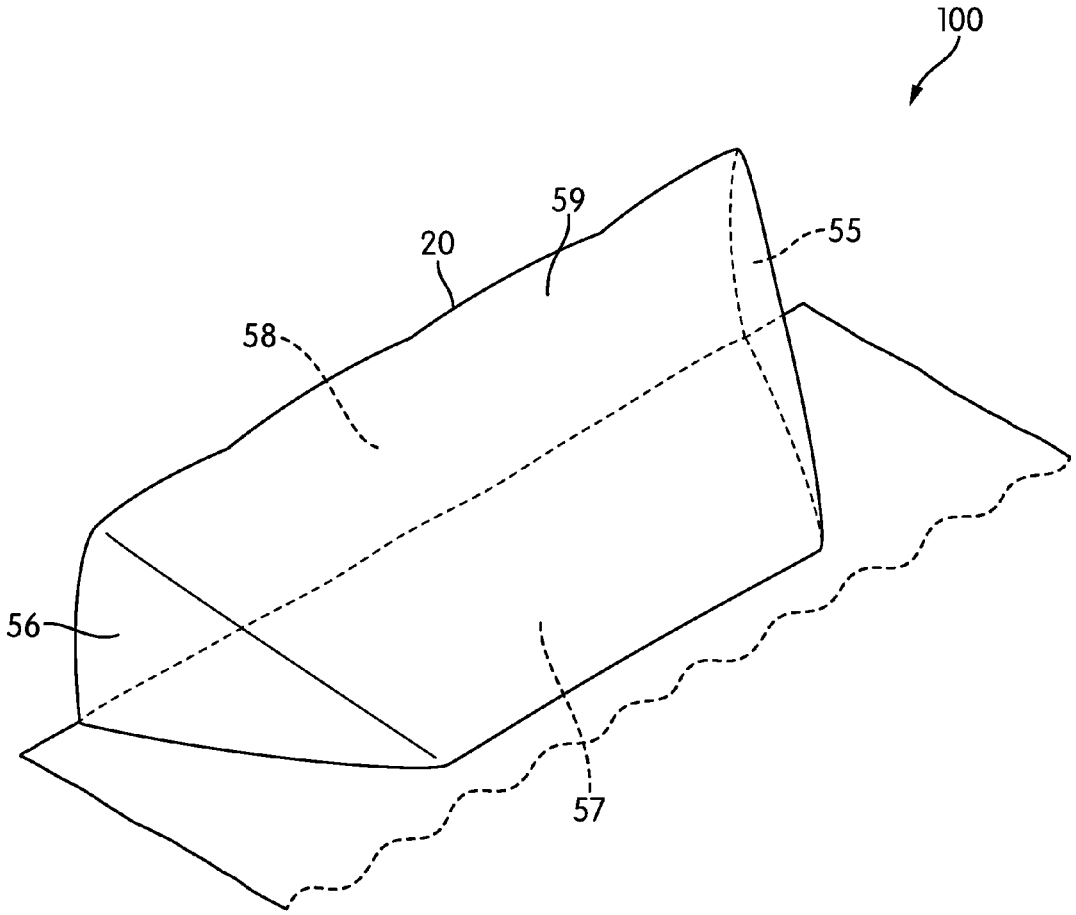
FIG. 6 is a perspective view of the left inflatable chamber (20) while the left inflatable chamber (20) is inflated, as viewed from the foot end of the turning pad (29). The left inflatable chamber (20) is shown in a double trapezoid wedge shape.

A wedge is defined as a volume bounded by two triangles and three trapezoids. A trapezoid is defined as a quadrilateral with at least one pair of parallel sides. A first version of a wedge ("double trapezoid wedge") is a volume bounded by two triangles, two trapezoids, and one rectangle (a special type of trapezoid). An inflatable chamber in the shape of a double trapezoid wedge has five surfaces: a head end triangle (55), a foot end triangle (56), a base trapezoid (57), an outer side rectangle (58) and an inner side slanted trapezoid (59). The inner side slated trapezoid (59) is the preferred support surface ("slanted support surface"). FIG. 6 is a perspective view of the left inflatable chamber (20) while the left inflatable chamber (20) is inflated, as viewed from the foot end of the turning pad (29). The left inflatable chamber (20) is shown in a double trapezoid wedge shape.

Figure 7:
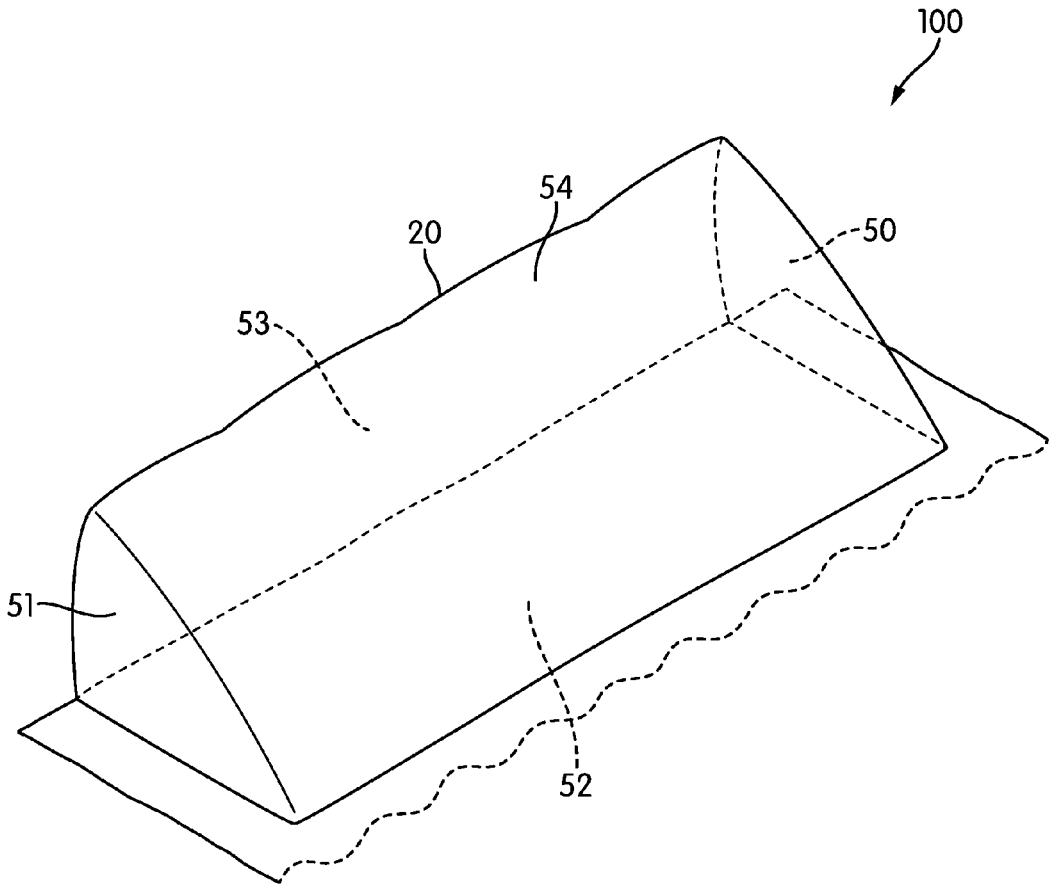
FIG. 7 is a perspective view of the left inflatable chamber (20) while the left inflatable chamber (20) is inflated, as viewed from the foot end of the turning pad (29). The left inflatable chamber (20) is shown in a triangle prism wedge shape.

A second version of a wedge is the triangular prism, where the volume is bounded by two triangles and three rectangles (a special type of trapezoid). An inflatable chamber in the shape of a triangular prism has five surfaces: head end triangle (50), a foot end triangle (51), a base rectangle (52), an outer side rectangle (53) and an inner side slanted rectangle (54). The inner side slated rectangle (54) is the preferred support surface. FIG. 7 is a perspective view of the left inflatable chamber (20) while the left inflatable chamber (20) is inflated, as seen from the foot end of the turning pad (29). The left inflatable chamber (20) is shown in a triangle prism wedge shape.

The "head end" is the area where a patient's upper extremities are placed. The "foot end" is the area where a patient's lower extremities are placed.

When inflated, the left inflatable chamber (20) tilts up the right side of a patient's body and places the left side of a patient's body against a surface. When inflated, the right inflatable chamber (22) tilts up the left side of a patient's body and places the right side of a patient's body against a surface.

Figure 3:
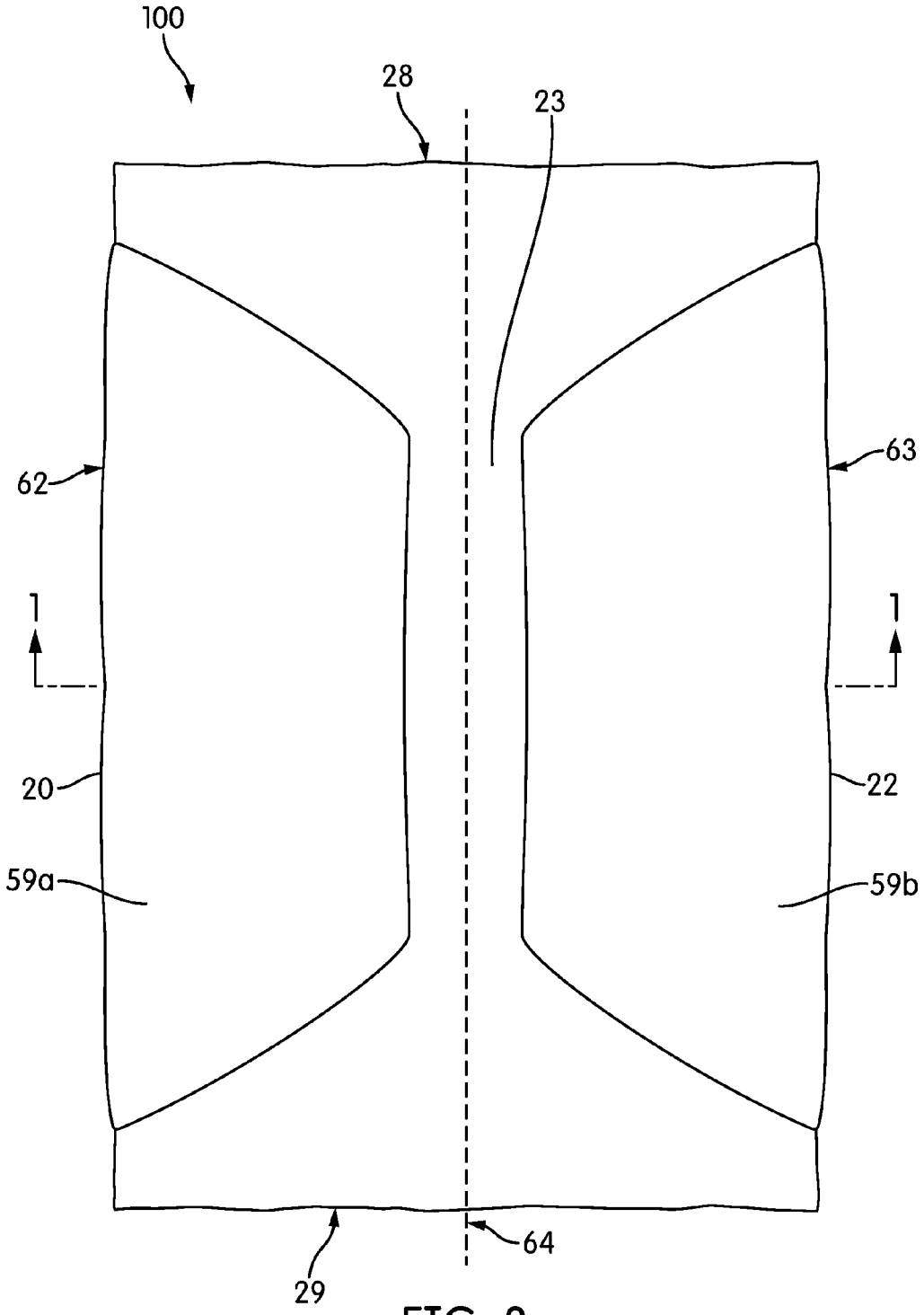
FIG. 3 is a top view of the turning pad (100), showing the left inflatable chamber (20) and right inflatable chamber (22) fastened to a base pad (23). The left inflatable chamber (20) and the right inflatable chamber (22) are shown in a double trapezoid wedge shape.

For illustrative purposes, the embodiment discussed for this point onwards refers to a turning pad (100) with a left inflatable chamber (20) and right inflatable chamber (22) in the shape of double trapezoid wedges. FIG. 3 is a top view of the turning pad (100), showing the left inflatable chamber (20) and right inflatable chamber (22) fastened to a base pad (23).

The left inflatable chamber (20) and the right inflatable chamber (22) are positioned over the base pad (23) so that their respective support surfaces are oriented towards each other. FIG. 1 shows a sectional view of the turning pad (100) of FIG. 3 taken at the sectioning place and in the direction indicated by section lines 1-1, showing the left inflatable chamber (20) and the right inflatable chamber (22), fastened to a base pad (23) sharing a common surface, as viewed from the foot end of the turning pad (29). The left inflatable chamber (20) and the right inflatable chamber (22) are shown inflated. The left inflatable chamber (20) is oriented so that its slanted support surface (the inner side slanted trapezoid (59*a*)), also known as the left chamber slanted support surface is oriented towards the slanted support surface of the right inflatable chamber (22) (the inner side slanted trapezoid (59*b*)), also known as the right chamber slanted support surface. The right inflatable chamber (22) and the left inflatable chamber (20) are oriented parallel to an imaginary straight line running from the head end of the turning pad (28) to the foot end of the turning pad (29) along the center line of the turning pad (64).

Figure 25:
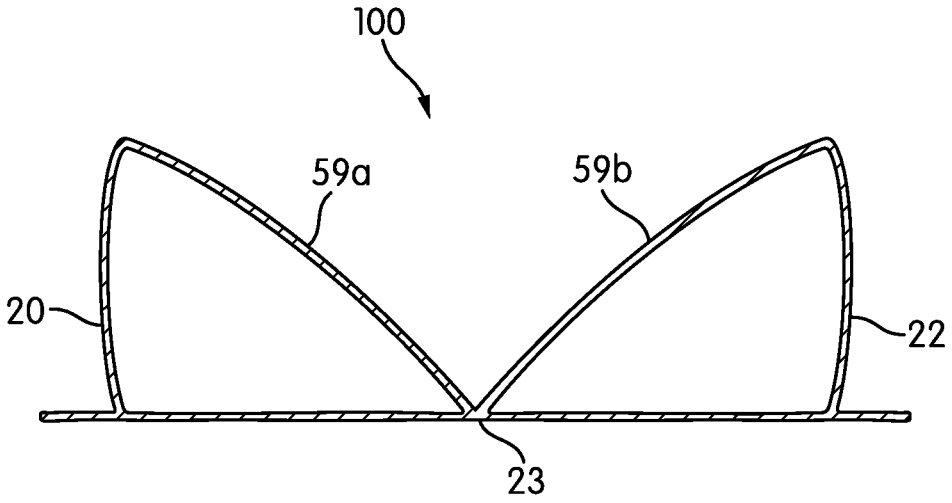
FIG. 25 shows a different positioning of the left inflatable chamber (20) and the right inflatable chamber (22) relatively to the base pad (23).
Figure 26:
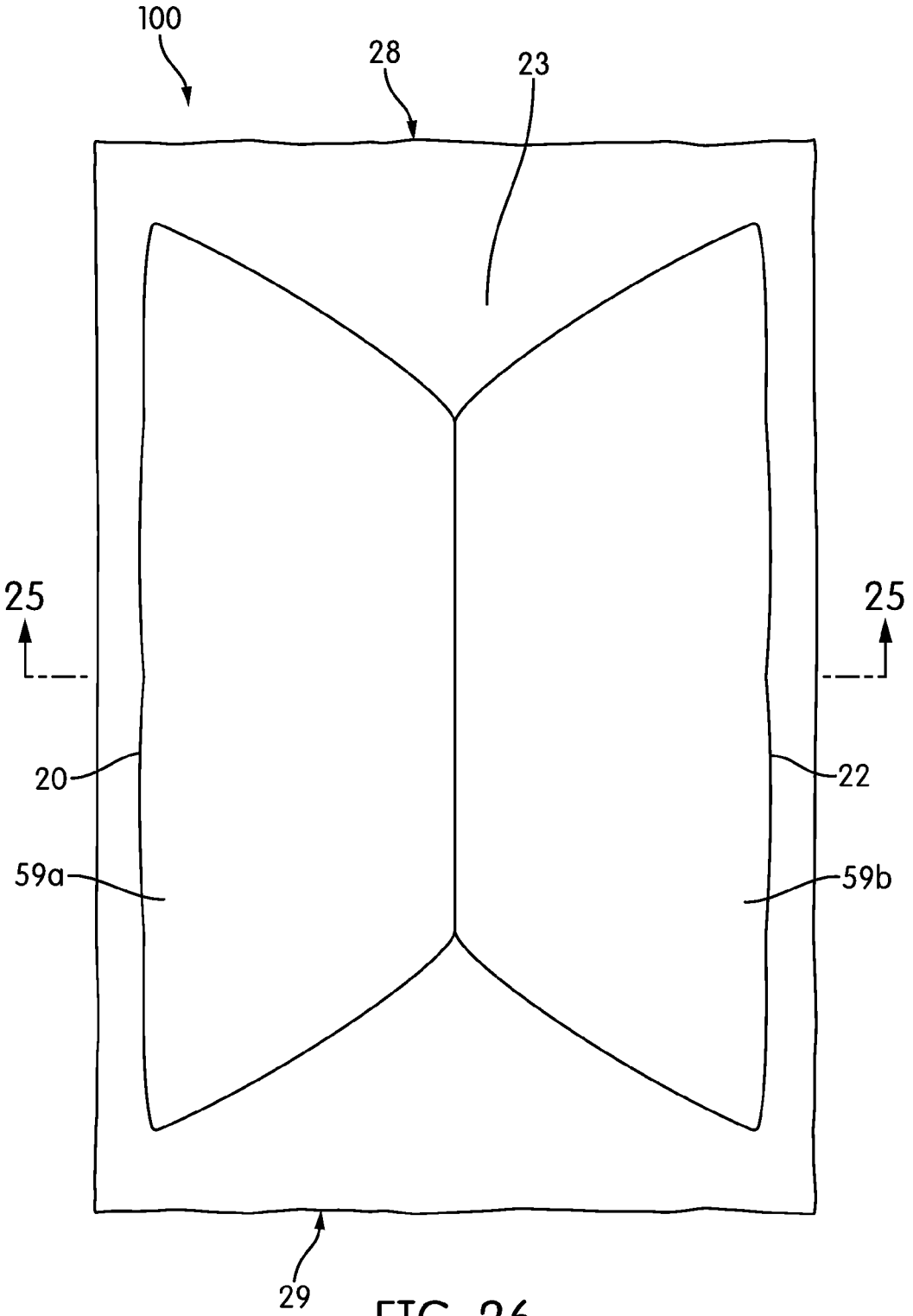
FIG. 26 is a top view of the turning pad (100), showing the left inflatable chamber (20) and right inflatable chamber (22) fastened to a base pad (23). The left inflatable chamber (20) and the right inflatable chamber (22) meet at the center line of the turning pad (64).

FIG. 25 shows a different positioning of the left inflatable chamber (20) and the right inflatable chamber (22) relatively to the base pad (23). FIG. 25 shows a sectional view of the turning pad (100) of FIG. 26 taken at the sectioning place and in the direction indicated by section lines 25-25, showing the left inflatable chamber (20) and the right inflatable chamber (22), fastened to a base pad (23), as viewed from the foot end of the turning pad (29). The left inflatable chamber (20) and the right inflatable chamber (22) meet at the center line of the turning pad (64). FIG. 26 is a top view of the turning pad (100), showing the left inflatable chamber (20) and right inflatable chamber (22) fastened to a base pad (23). The left inflatable chamber (20) and the right inflatable chamber (22) meet at the center line of the turning pad (64). FIG. 3 shows the relative locations of the turning pad (100): the head end (28), the foot end (29), the left side (62), the right side (63), and the center line (64).

Figure 8:
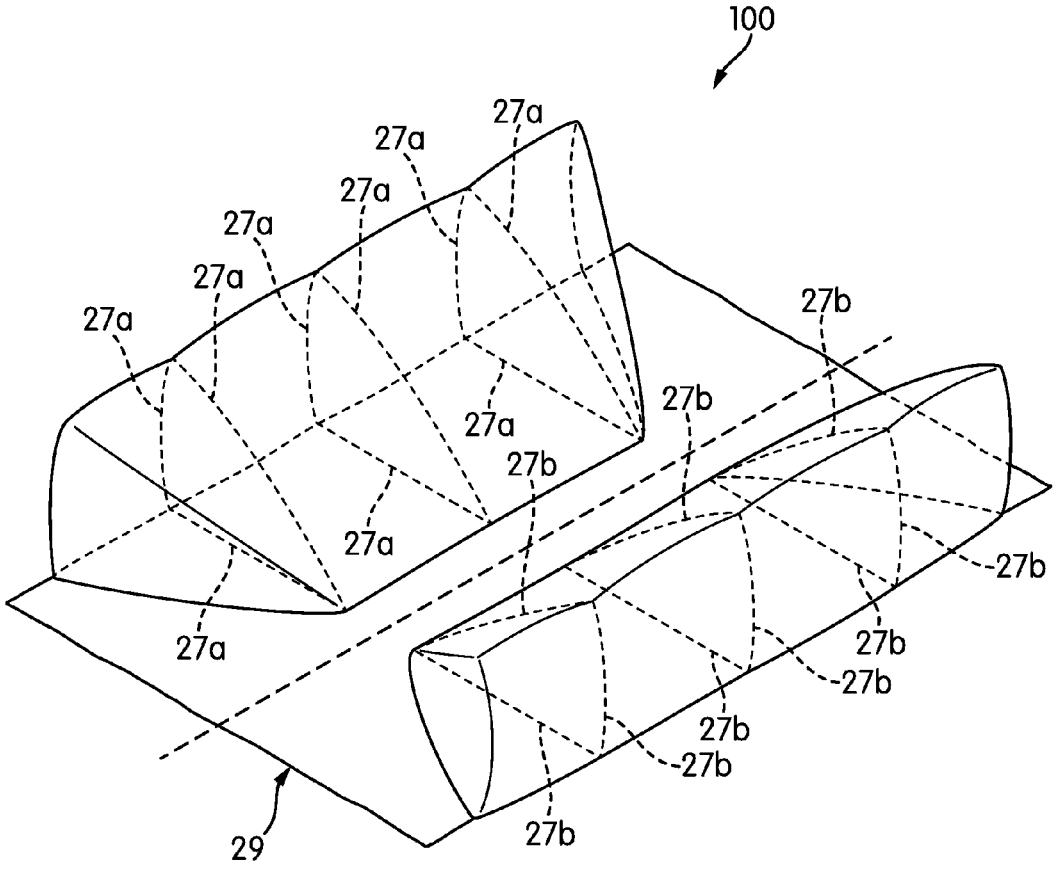
FIG. 8 is a perspective inside view of the left inflatable chamber (20) showing the left chamber support structures (27*a*) needed to hold the shape of the left inflatable chamber (20) while the left inflatable chamber (20) is inflated, as viewed from the foot end of the turning pad (29).

Support structures (27) are fastened to the inside surface of the fabric material of the air chambers to hold the shape of the inflatable chambers. Right chamber support structures (27*b*) are fastened to a right chamber inside surface (61). Left chamber support structures (27*a*) are fastened to a left chamber inside surface (60). The ends of these support structures (27) are joined together to form ring like structures that are fastened to the inflatable chambers' inside surface. For example, support structures (27) would form a triangular ring when the inflatable chambers are in the shape of a wedge since the cross-section of these volumes would be triangular. Support structures (27) would form a rectangular ring when the inflatable chambers are in the shape of a rectangular prism since the cross-section of these volumes would be rectangular. The support structures (27) do not impede the air flow through the inside of the air chambers. FIG. 8 is a perspective inside view of the left inflatable chamber (20) showing the left chamber support structures (27*a*) needed to hold the shape of the left inflatable chamber (20) while the left inflatable chamber (20) is inflated, as viewed from the foot end of the turning pad (29). FIG. 8 also shows a perspective inside view of the right inflatable chamber (22) showing the support structures (27*b*) needed to hold the shape of the right inflatable chamber (22) while the right inflatable chamber (22) is inflated. The left inflatable chamber (20) and the right inflatable chamber (22) are shown in a double trapezoid wedge shape.

The base pad (23) comprises of a base sheet (24). In this embodiment, the base sheet (24) and the base pad are the same element (23). The left inflatable chamber (20) and the right inflatable chamber (22) are fastened to the top side of the base sheet (24). Alternatively, the left inflatable chamber (20) and the right inflatable chamber (22) may share a common surface with the base sheet (24).

In another embodiment of the invention, the base pad (23) comprises a base sheet (24), a left securing sleeve (25) and a right securing sleeve (26). A sleeve is defined as a single continuous structure with one or two open ends that fits over something else. The left securing sleeve (25) and the right securing sleeve (26) are fastened to the top side of the base sheet (24). Alternatively, the left securing sleeve (25) and right securing sleeve (26) may share a common surface with the base sheet (24). The right inflatable chamber (22) can be inserted into the right securing sleeve (26) through the right securing sleeve's open ends. The left inflatable chamber (20) can be inserted into the left securing sleeve (25) through the left securing sleeve's (25) open ends. Having two open ends allows the left inflatable chamber (20) and right inflatable chamber (22) to be inserted from either the head end of the turning pad (28) or the foot end of the turning pad (29).

The left securing sleeve (25) and the right securing sleeve (26) are oriented to allow the support surfaces of the right inflatable chamber (22) and the left inflatable chamber (20) to be oriented towards each other. The left securing sleeve (25) and the right securing sleeve (26) are oriented parallel to an imaginary straight line running from the head end of the turning pad (28) to the foot end of the turning pad (29) along the center line of the turning pad (64).

The left securing sleeve (25) secures the left inflatable chamber (20) in place over the base sheet (24) to prevent movement of the left inflatable chamber (20). The right securing sleeve (26) secures the right inflatable chamber (22) in place over the base sheet to prevent movement of the right inflatable chamber (22). For instance, the shape and size of the left securing sleeve (25) may match the size and shape of the left inflatable chamber (20), and the shape and size of the right securing sleeve (26) may match the size and shape of the right inflatable chamber (22), creating a very tight fit between the sleeves and the inflatable chambers when either of the inflatable chambers (20, 22) are inflated.

Having the ability for the inflatable chambers (20, 22) to be inserted and removed from the base pad (23) allows the base pad (23) to be maintained separately from the left and right inflatable chambers (20, 22). For example, if the base pad (23) needs to be laundered, it can substituted with another clean base pad (23), allowing for continued use of the left and right inflatable chambers (20, 22).

Figure 10:
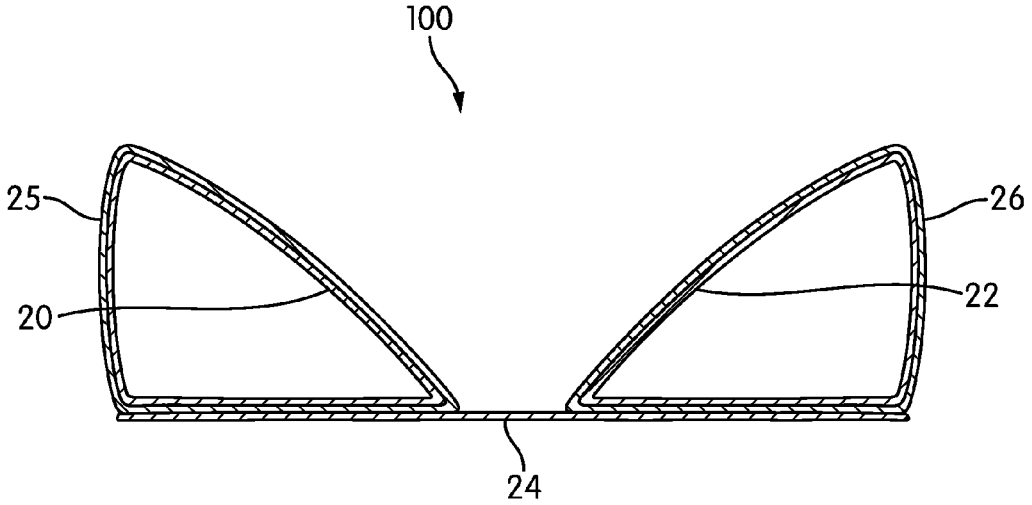
FIG. 10 shows a sectional view of the turning pad (100) of FIG. 11 taken at the sectioning plane and in the direction indicated by section lines 10-10, showing a left securing sleeve (25) and a right securing sleeve (26) fastened to a base sheet (24), as viewed from the foot end of the turning pad (29). The left inflatable chamber (20) is shown inserted inside the left securing sleeve (25) and the right inflatable chamber (22) is shown inserted inside the right securing sleeve (26). The left inflatable chamber (20) and the right inflatable chamber (22) are shown inflated.
Figure 11:
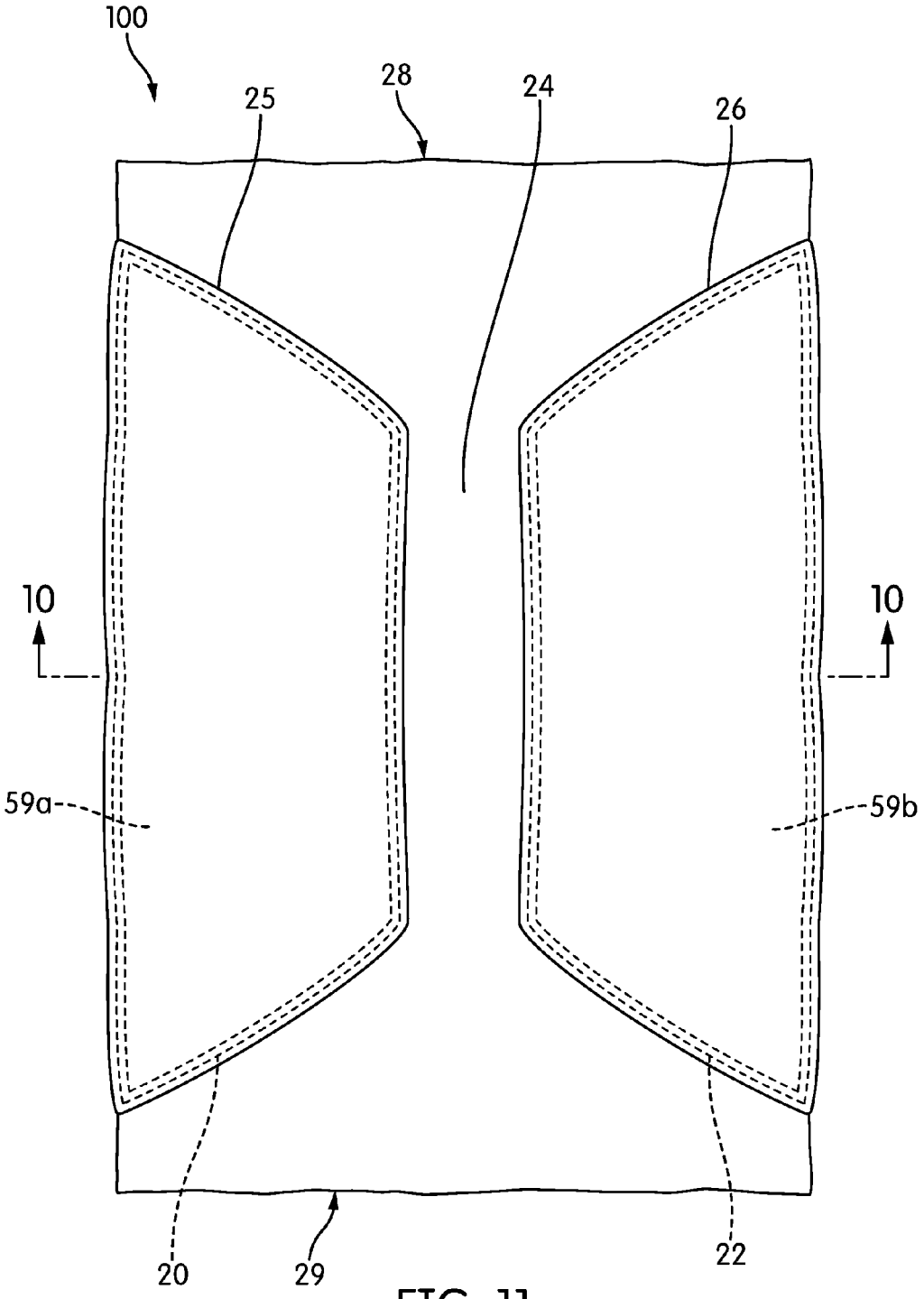
FIG. 11 is a top view of the turning pad (100), showing a left securing sleeve (25) and a right securing sleeve (26) fastened to a base sheet (24) The left inflatable chamber (20) and the right inflatable chamber (22) are shown inserted inside the left securing sleeve (25) and the right securing sleeve (26) respectively. The left inflatable chamber (20) and the right inflatable chamber (22) are shown in a double trapezoid wedge shape.

FIG. 10 shows a sectional view of the turning pad (100) of FIG. 11 taken at the sectioning plane and in the direction indicated by section lines 10-10, showing a left securing sleeve (25) and a right securing sleeve (26) fastened to a base sheet (24). The left inflatable chamber (20) is shown inserted inside the left securing sleeve (25) and the right inflatable chamber (22) is shown inserted inside the right securing sleeve (26). The left inflatable chamber (20) and the right inflatable chamber (22) are shown inflated. The left chamber slanted support surface (59*a*) is oriented towards the left chamber slanted support surface (59*b*). FIG. 11 is a top view of the turning pad (100), showing a left securing sleeve (25) and a right securing sleeve (26) fastened to a base sheet (24). The left inflatable chamber (20) and the right inflatable chamber (22) are shown inserted inside the left securing sleeve (25) and the right securing sleeve (26) respectively. The left inflatable chamber (20) and the right inflatable chamber (22) are shown in a double trapezoid wedge shape. The left chamber slanted support surface (59*a*) is oriented towards the left chamber slanted support surface (59*b*).

The turning pad (100) is placed on top of a hospital bed. When in used in connection with labor, the turning pad (100) is placed on top of a standard labor bed. A standard labor bed comprises of two separate sections. A patient's torso is placed over the upper section of a standard labor bed, while the lower extremities are placed over the lower section. At the time of delivery, the lower section is removed in order to place the patient's legs in stirrups or foot pedals, allowing labor and delivery health care providers access to the perineum for delivery. The turning pad (100) is secured to the upper section of a standard labor bed either by friction or by fasteners that connect the turning pad (100) to the standard labor bed.

Figure 2:
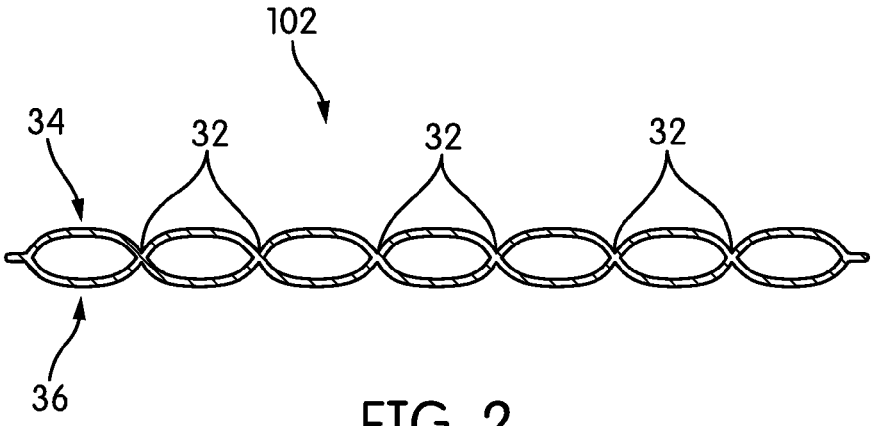
FIG. 2 shows a sectional view of the inflatable positioning pad (102) of FIG. 4 taken at the sectioning place and in the direction indicated by section lines 2-2, showing the top surface of inflatable positioning pad (34), the bottom surface of the inflatable positioning pad (36), and a plurality of seams (32).
Figure 4:
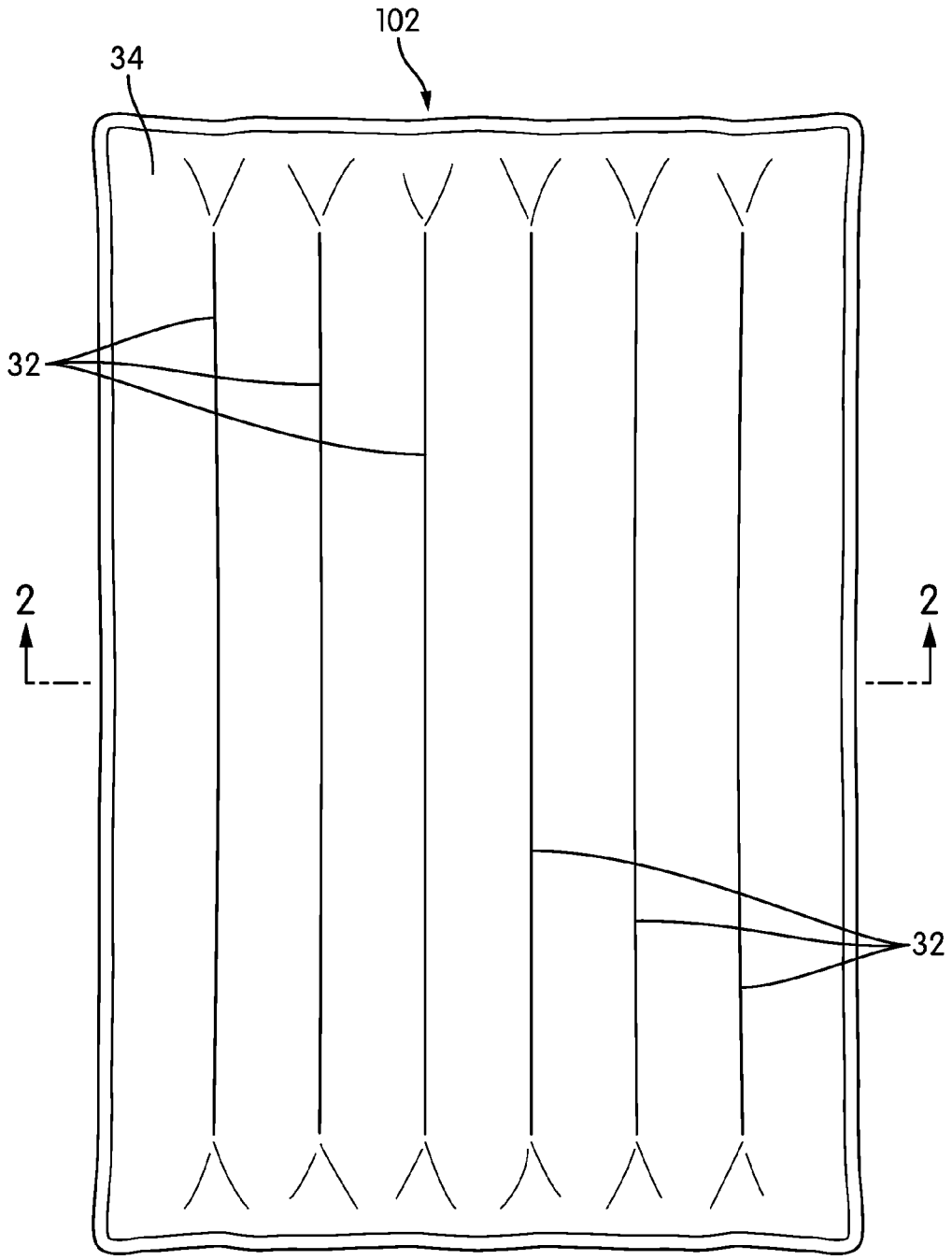
FIG. 4 is a top view of the inflatable positioning pad (102) with a plurality of seams (32).

The inflatable positioning pad (102) is used to assist patient turning and patient shifting. The inflatable positioning pad (102) is preferably shaped as a rectangular prism but can be shaped in a number of other shapes, such as quadrilateral prism, a triangular prism, or a cylinder. The inflatable positioning pad (102) is an inflatable chamber comprising of a top surface of the inflatable positioning pad (34) and a bottom surface of the inflatable positioning pad (36). The top surface of the inflatable positioning pad (34) and the bottom surface of the inflatable positioning pad (36) may be fastened to each other at their edges or may be formed from a single piece of material. The inflatable positioning pad (102) can be inflated or deflated. The inflatable positioning pad (102) has a plurality of seams (32) that are created in places where the top surface of the inflatable positioning pad (34) is fastened to the bottom surface of the inflatable positioning pad (36). These seams (32) create cavities inside the inflatable positioning pad (102) that control the flow of air inside the inflatable positioning pad (102). The use of seams (32) allows the top surface of the inflatable positioning pad (34) and the bottom surface of the inflatable positioning pad (36) to maintain a relative flat profile. The seams (32) need to positioned so that air flows to all parts inside of the inflatable positioning pad (102). A preferred embodiment has the seams positioned parallel to each other. FIG. 2 shows a sectional view of the inflatable positioning pad (102) of FIG. 4 taken at the sectioning place and in the direction indicated by section lines 2-2, showing the top surface of inflatable positioning pad (34), the bottom surface of the inflatable positioning pad (36), and a plurality of seams (32). FIG. 2 also shows the relative flat profile of the inflatable positioning pad (102) that is created by the seams. FIG. 4 is a top view of the inflatable positioning pad (102) with a plurality of seams (32).

Figure 5:
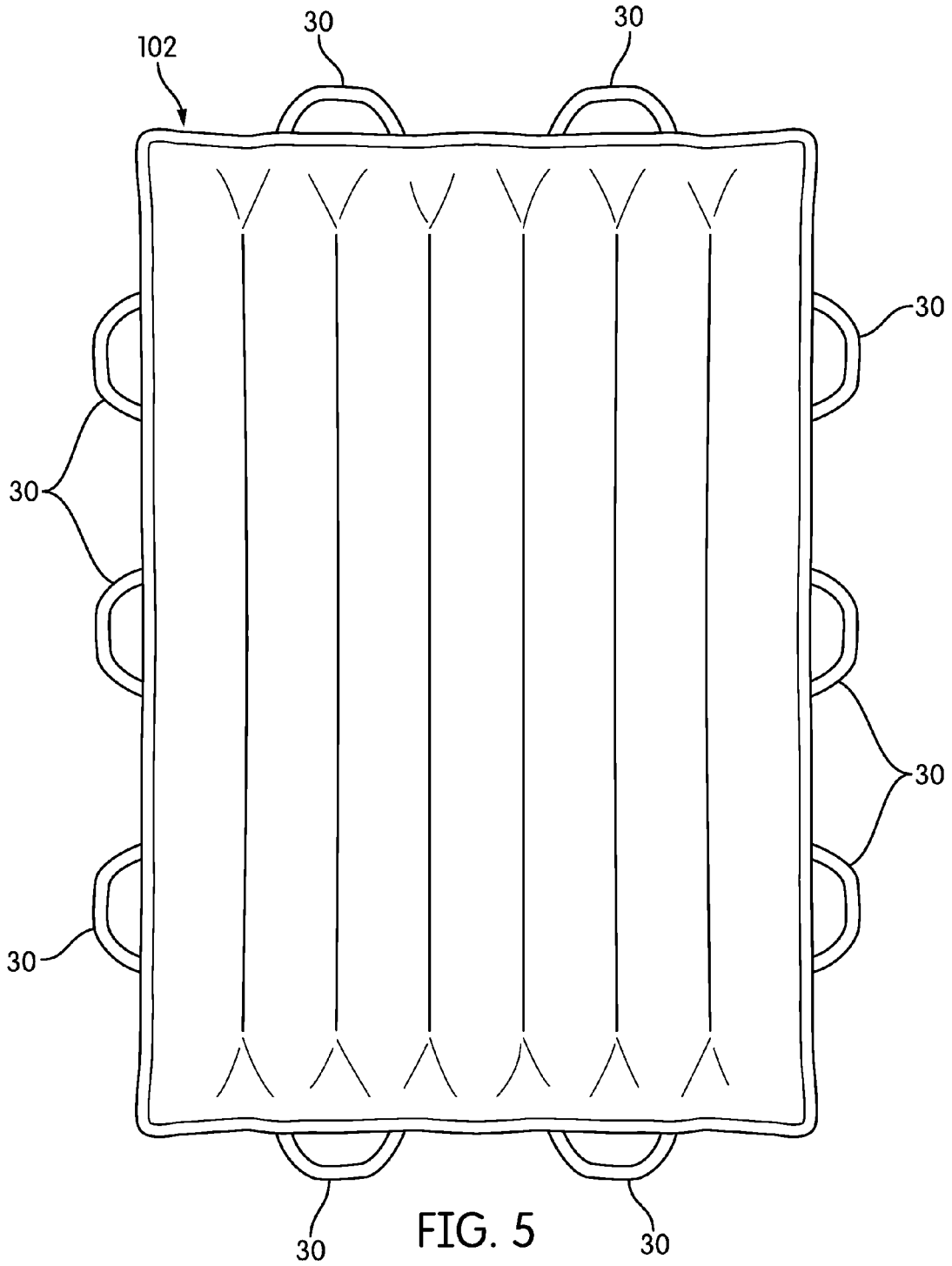
FIG. 5 is a top view of the inflatable positioning pad (102) with a plurality of seams (32), and a plurality of handles (30) attached to the sides of the inflatable positioning pad (102).

The inflatable positioning pad (102) may have one or more handles (30) located along the side(s) of the inflatable positioning pad (102) to enhance the labor nurses' grasp of the inflatable positioning pad (102). This enhanced grasp would allow for easier patient turning and patient shifting. FIG. 5 is a top view of the inflatable positioning pad (102) with a plurality of seams (32), and a plurality of handles (30) attached to the sides of the inflatable positioning pad (102). FIG. 4 and FIG. 5 show the inflatable positioning pad (102) in the shape of a rectangular prism.

The turning pad (100) and the inflatable positioning pad (102) are made of a fabric material that is semi-permeable to air. This semi-permeable nature of the fabric material permits the air within the left inflatable chamber (20), right inflatable chamber (22) or the inflatable positioning pad (102) to escape through the fabric onto the outside atmosphere. To maintain the left inflatable chamber (20), right inflatable chamber (22) or the inflatable positioning pad (102) inflated, air is supplied at a predetermined rate. If the air-supply rate drops below this predetermined air-supply rate, the left inflatable chamber (20), right inflatable chamber (22) or the inflatable positioning pad (102) will deflate immediately due to the semi-permeable nature of the fabric material. The rate of deflation is highest when the air-supply rate becomes zero. The rate of deflation is also a function of the air permeability characteristics of the fabric material. Semi permeable fabric material that allows for a high flow of air through the fabric material would allow for a more rapid rate of deflation of the inflated components (20, 22, 102) than semi permeable fabric material that allows for a low flow of air. The semi permeable nature of the fabric material eliminates the need for additional devices, valves, solenoids, controls, or procedures to enable deflation of the various air compartments.

When the left inflatable chamber (20), right inflatable chamber (22) and the inflatable positioning pad (102) are inflated, air escapes through the semi-permeable fabric material due to the pressure within the left inflatable chamber (20), right inflatable chamber (22) and the inflatable positioning pad (102). This escaping air produces a frictionless air bearing (110) between the fabric and the surface the fabric lies over. This frictionless air bearing (110) is further enhanced when the inflatable positioning pad (102) is placed over the left inflatable chamber (20) or the right inflatable chamber (22), since both adjoining surfaces contribute air to the frictionless air bearing (110). This frictionless air bearing (110) allows for easier movement of the inflatable positioning pad (102) over the turning pad (100). The movement of the inflatable positioning pad (102) over the turning pad (100) is further enhanced when the turning pad (100) and the inflatable positioning pad (102) are made of a fabric material that provides low surface friction properties.

When the left inflatable chamber (20), right inflatable chamber (22) and the inflatable positioning pad (102) are inflated, the surfaces of the left inflatable chamber (20), right inflatable chamber (22) and the inflatable positioning pad (102) will most likely not have a flat profile given the flexible properties of the fabric material; rather, these surfaces might acquire a curved or slightly bulged profile.

In another embodiment of the invention, the turning pad (100) and the inflatable positioning pad (102) are made of a fabric material that is impermeable to air.

Figure 23:
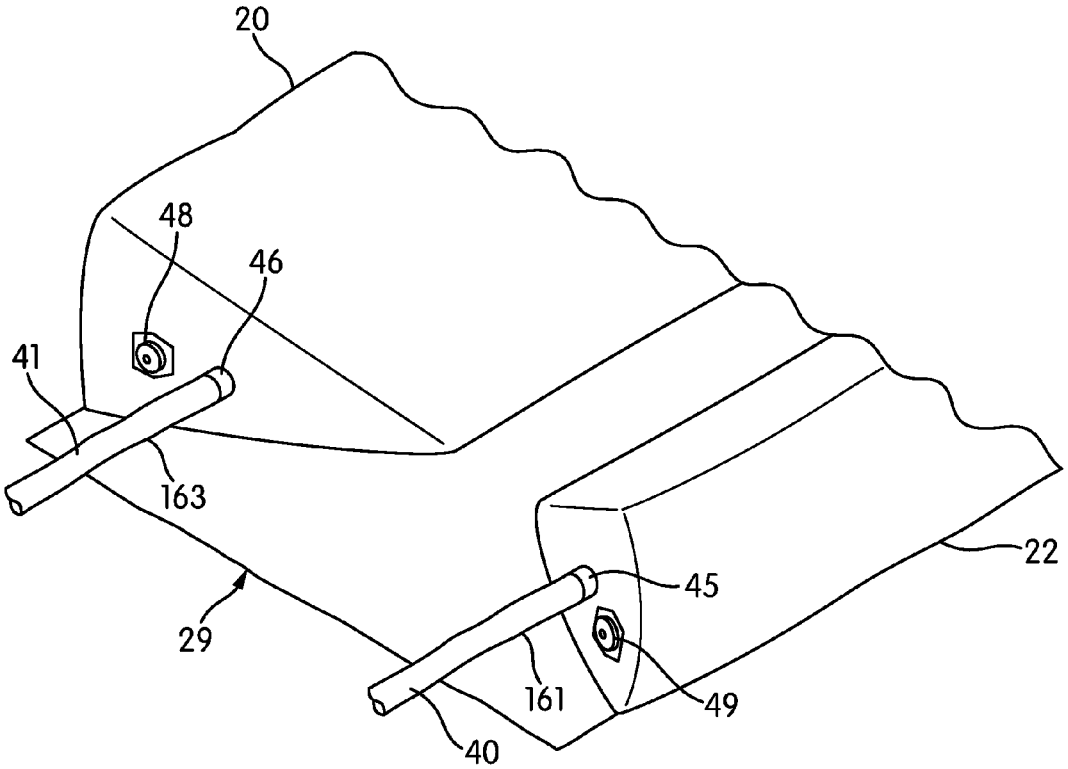
FIG. 23 is a perspective view of the foot end of the turning pad (29) showing a left air-release valve (48) and a left chamber connector (46) attached to the left inflatable chamber (20).

To aid with the deflation of the left inflatable chamber (20), a left air-release valve (48) may be attached to the left inflatable chamber (20). To aid with the deflation of the right inflatable chamber (22), a right air-release valve (49) may be attached to the right inflatable chamber (22). The left air-release valve (48) and the right air-release valve (49) are configured so that the labor nurse can quickly open either the left air-release valve (48) and the right air-release valve (49). The left air-release valve (48) is sized to enable quick deflation of the left inflatable chamber (20), and the right air-release valve (49) is sized to enable quick deflation of the right inflatable chamber (22). The left air-release valve (48) and the right air-release valve (49) are positioned so that they are quickly accessed by the labor nurse. FIG. 23 is a perspective view of the foot end of the turning pad (29) showing a left air-release valve (48) and a left chamber connector (46) attached to the left inflatable chamber (20). FIG. 23 also shows a right air-release valve (49) and a right chamber connector (45) attached to the right inflatable chamber (22).

Figure 24:
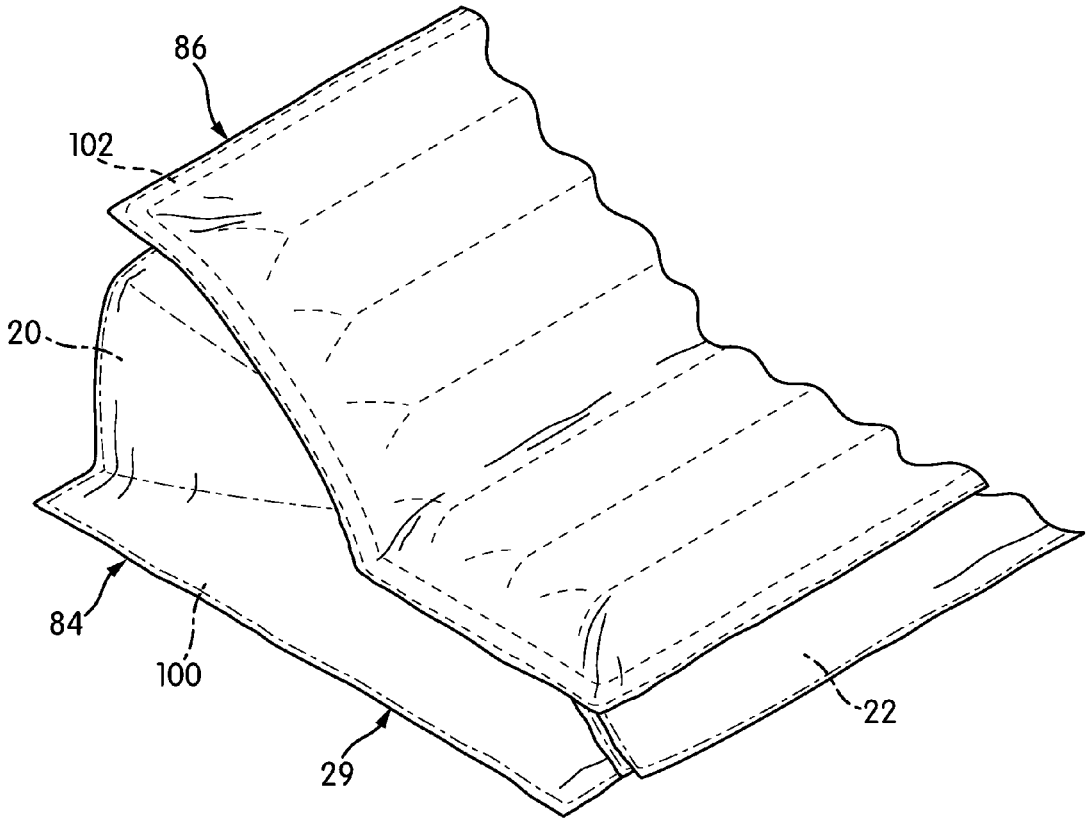
FIG. 24 shows a turning pad sheath (84) covering the turning pad (100) and an inflatable positioning pad sheath (86) covering the inflatable positioning pad (102).

The turning pad (100) and the inflatable positioning pad (102) can be protected with sheaths that slide over the turning pad (100) and the inflatable positioning pad (102). The sheaths are preferably made of a fabric material that has similar air permeability characteristics as the fabric material of the inflatable positioning pad (102) and the turning pad (100). The sheaths can either be disposable or re-usable. FIG. 24 shows a turning pad sheath (84) covering the turning pad (100) and an inflatable positioning pad sheath (86) covering the inflatable positioning pad (102).

Figure 17:
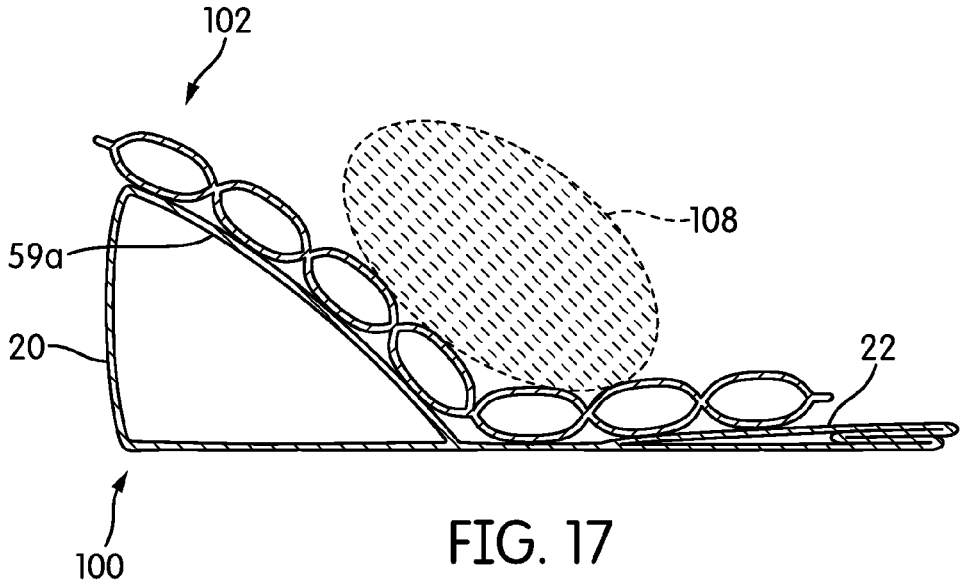
FIG. 17 is a sectional view of a patient (108) laying on her left side while the left inflatable chamber (20) is inflated and the right inflatable chamber (22) is deflated, as viewed from the foot end of the turning pad (29). The inflatable positioning pad (102) lies between a patient (108) and the turning pad (100).
Figure 18:
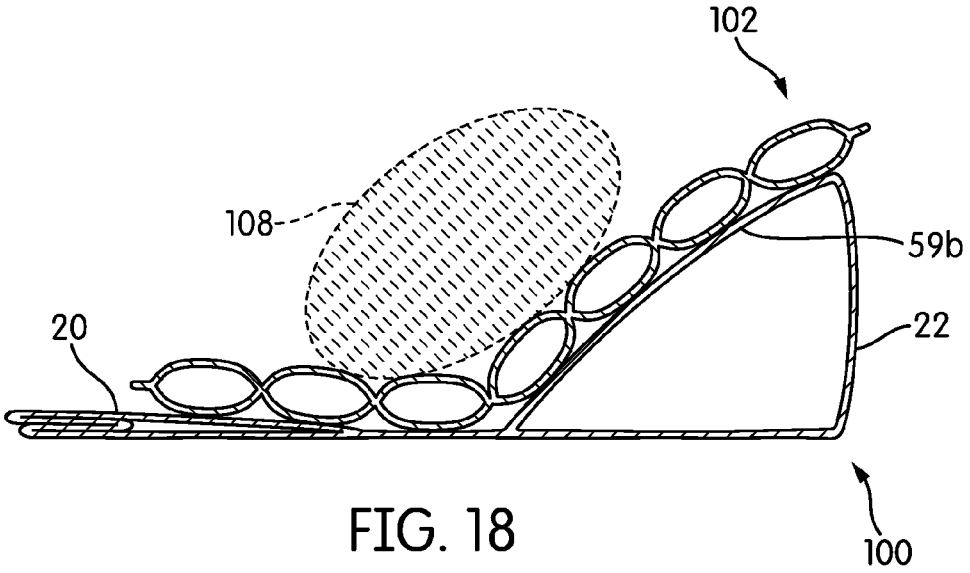
FIG. 18 is a sectional view of a patient (108) laying on her right side while the right inflatable chamber (22) is inflated and the left inflatable chamber (20) is deflated, as viewed from the foot end of the turning pad (29). The inflatable positioning pad (102) lies between a patient (108) and the turning pad (100).

The inflatable positioning pad (102) is placed between a patient (108) and the turning pad (100). When turning or shifting a patient (108), force is applied to the inflatable positioning pad (102). When the inflatable positioning pad (102) moves due to this force, a patient (108) lying over the inflatable positioning pad (102) will move with the inflatable positioning pad (102). Pressure may have to be applied against a patient (108) so that a patient remains over the inflatable positioning pad (102) when force is applied to the inflatable positioning pad (102). The inflatable positioning pad (102) is used to shift a patient around the turning pad (100) and the hospital bed. For example, the inflatable positioning pad (102) can be used to move a patient (108) up toward the head of the bed or to pull a patient (108) to the foot of the bed for better positioning or procedures such as vaginal delivery or repair. The inflatable positioning pad (102) can be used to move a patient (108) from one side of the bed to the other side of the bed. The inflatable positioning pad (102) can be used inflated or deflated, depending on the medical situation and labor nurse's preference. FIG. 17 is a sectional view of a patient (108) laying on her left side while the left inflatable chamber (20) is inflated and the right inflatable chamber (22) is deflated. The inflatable positioning pad (102) lies between a patient (108) and the turning pad (100). FIG. 18 is sectional view of a patient (108) laying on her right side while the right inflatable chamber (22) is inflated and the left inflatable chamber (20) is deflated. The inflatable positioning pad (102) lies between a patient (108) and the turning pad (100).

The air-supply system (106) delivers air to the left inflatable chamber (20), right inflatable chamber (22), and inflatable positioning pad (102) at a rate appropriate to maintain the right inflatable chamber (22), the left inflatable chamber (20) and inflatable positioning pad (102) at their desired inflation levels. The air-supply system (106) preferable has an air blower or air compressor.

Figure 9:
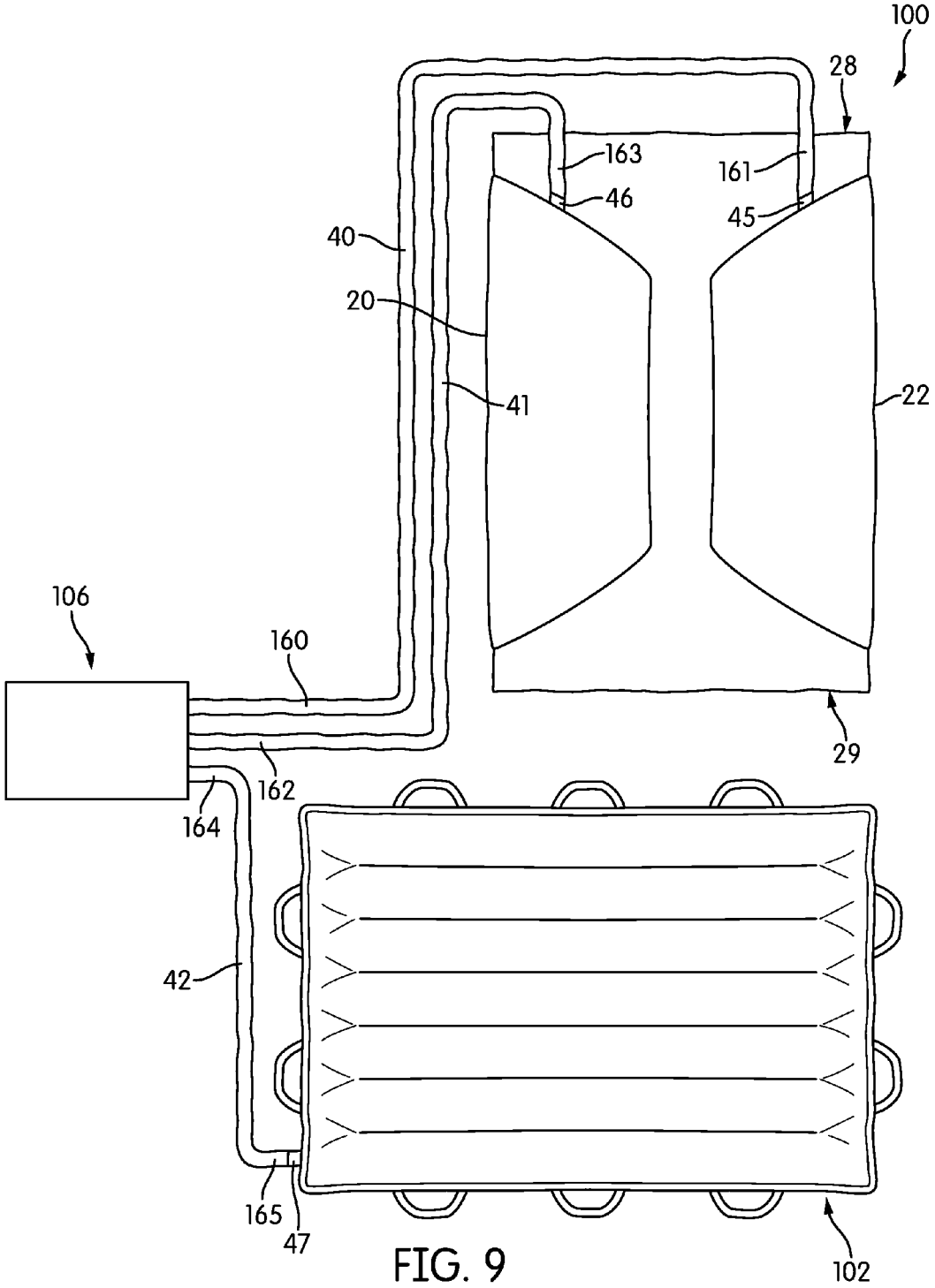
FIG. 9 is a top view of the turning device, showing the turning pad (100), inflatable positioning pad (102), air-supply system (106), and the air-supply hoses (104) comprising of a right chamber air-hose (40), a left chamber air-hose (41) and an inflatable positioning pad air-hose (42). The left chamber air-hose (41) has a first end (162) and a second end (163); the right chamber air-hose (40) has a first end (160) and a second end (161); the inflatable positioning pad air-hose (42) has a first end (164) and a second end (165). The left chamber connector (46) is shown connected to the head end of the left inflatable chamber (20) by the head end of the turning pad (28). The right chamber connector (45) is shown connected to the head end of the left inflatable chamber (22) by the head end of the turning pad (28). The inflatable pad connector (47) is shown connected to the inflatable positioning pad (102).

Air-supply hoses (104) deliver air from the air-supply system (106) to the right inflatable chamber (22), left inflatable chamber (20), and the inflatable positioning pad (102). The air-supply hoses (104) comprise of a right chamber air-hose (40), a left chamber air-hose (41) and an inflatable positioning pad air-hose (42). The right chamber air-hose (40) connects the air-supply system (106) to a right chamber connector (45) that is attached to the right inflatable chamber (22). The right chamber air-hose (40) has a first end (160) and a second end (161), where the first end of the right chamber air-hose (160) is connected to the air-supply system (106) and the second end of the right chamber air-hose (161) is connected to the right chamber connector (45). The right chamber connector (45) is preferably placed at the head end of the right inflatable chamber (22) by the head end of the turning pad (28) to avoid entanglements with other medical equipment. Examples of such a connector are compression, snapping, locking, twisting or custom interlocking devices. The left chamber air-hose (41) connects the air-supply system (106) to a left chamber connector (46) that is attached to the left inflatable chamber (20). The left chamber air-hose (41) has a first end (162) and a second end (163), where the first end of the left chamber air-hose (162) is connected to the air-supply system (106) and the second end of the left chamber air-hose (163) is connected to the left chamber connector (46). The left chamber connector (46) is preferably placed at the head end of the left inflatable chamber (20) by the head end of the turning pad (28) to avoid entanglements with other medical equipment. The inflatable positioning pad air-hose (42) connects the air-supply system (106) to an inflatable positioning pad connector (47) that is attached to the inflatable positioning pad (102). The inflatable positioning pad air-hose (42) has a first end (164) and a second end (165), where the first end of the inflatable positioning pad air-hose (164) is connected to the air-supply system (106) and the second end of the inflatable positioning pad air-hose (165) is connected to the inflatable positioning pad connector (47). FIG. 9 is a top view of the turning device, showing the turning pad (100), inflatable positioning pad (102), air-supply system (106), and the air-supply hoses (104) comprising of a right chamber air-hose (40), a left chamber air-hose (41) and an inflatable positioning pad air-hose (42). The left chamber air-hose (41) has a first end (162) and a second end (163); the right chamber air-hose (40) has a first end (160) and a second end (161); the inflatable positioning pad air-hose (42) has a first end (164) and a second end (165). The left chamber connector (46) is shown connected to the head end of the left inflatable chamber (20) by the head end of the turning pad (28). The right chamber connector (45) is shown connected to the head end of the left inflatable chamber (22) by the head end of the turning pad (28). The inflatable pad connector (47) is shown connected to the inflatable positioning pad (102). FIG. 23 is a perspective view of the foot end of the turning pad (29) showing the second end of the right chamber air-hose (161) connected to the right chamber connector (45) and the second end of the left chamber air-hose (163) connected to the left chamber connector (46). The left chamber connector (46) is connected at the foot end of the left inflatable chamber (20) and the right chamber connector (45) is connected at the foot end of the right inflatable chamber (22).

Figure 19:
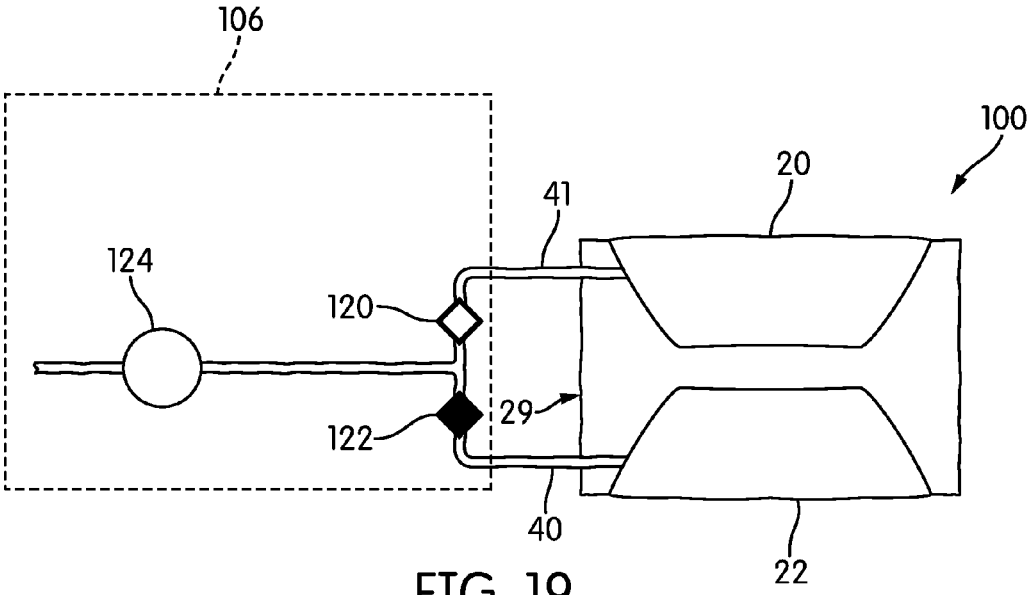
FIG. 19 is a schematic drawing showing the flow of air from the air source (124) through the left chamber air-supply valve (120) through the left chamber air-hose (41) into the left inflatable chamber (20).
Figure 20:
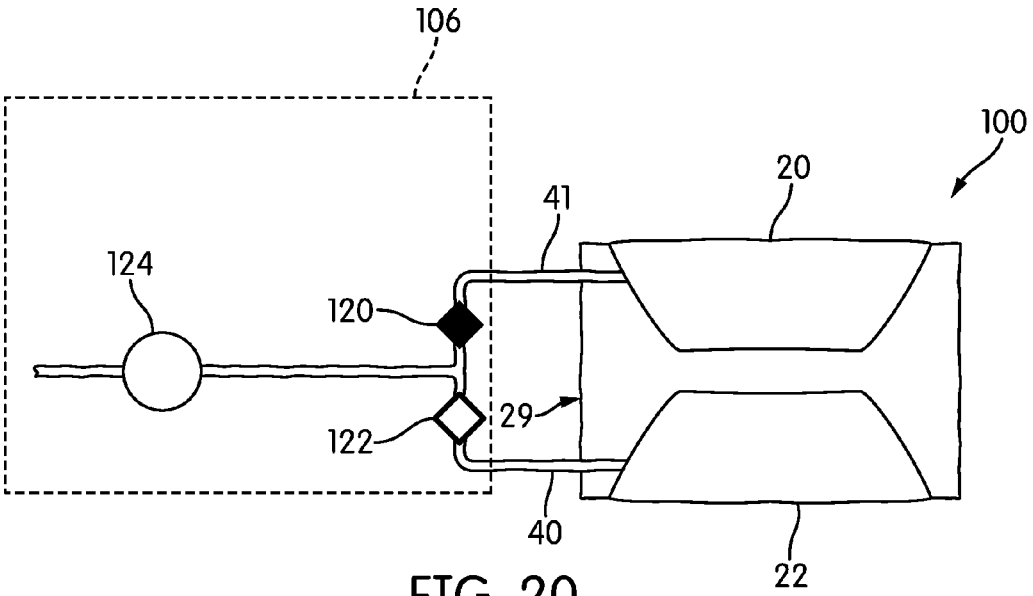
FIG. 20 is a schematic drawing showing the flow of air from the air source (124) through the right chamber air-supply valve (122) through the right chamber air-hose (40) into the right inflatable chamber (22).

Within the air-supply system (106), a plurality of valves are used to control the flow of air into the left inflatable chamber (20) and right inflatable chamber (22). When the left inflatable chamber (20) needs to be inflated, the left chamber air-supply valve (120) is opened and the right chamber air-supply valve (122) is closed. When the left chamber air-supply valve (120) is opened, it allows air to flow from the air source (124) through the left chamber air-hose (41) into the left inflatable chamber (20). FIG. 19 is a schematic drawing showing the flow of air from the air source (124) through the left chamber air-supply valve (120) through the left chamber air-hose (41) into the left inflatable chamber (20). When the right inflatable chamber (22) needs to be inflated, the right chamber air-supply valve (122) is opened and the left chamber air-supply valve (120) is closed. When the right chamber air-supply valve (122) is opened, it allows air to flow from the air source (124) through the right chamber air-hose (40) into the right inflatable chamber (22). The air source (124) also supplies air to the inflatable positioning pad (102). FIG. 20. is a schematic drawing showing the flow of air from the air source (124) through the right chamber air-supply valve (122) through the right chamber air-hose (40) into the right inflatable chamber (22).

Figure 21:
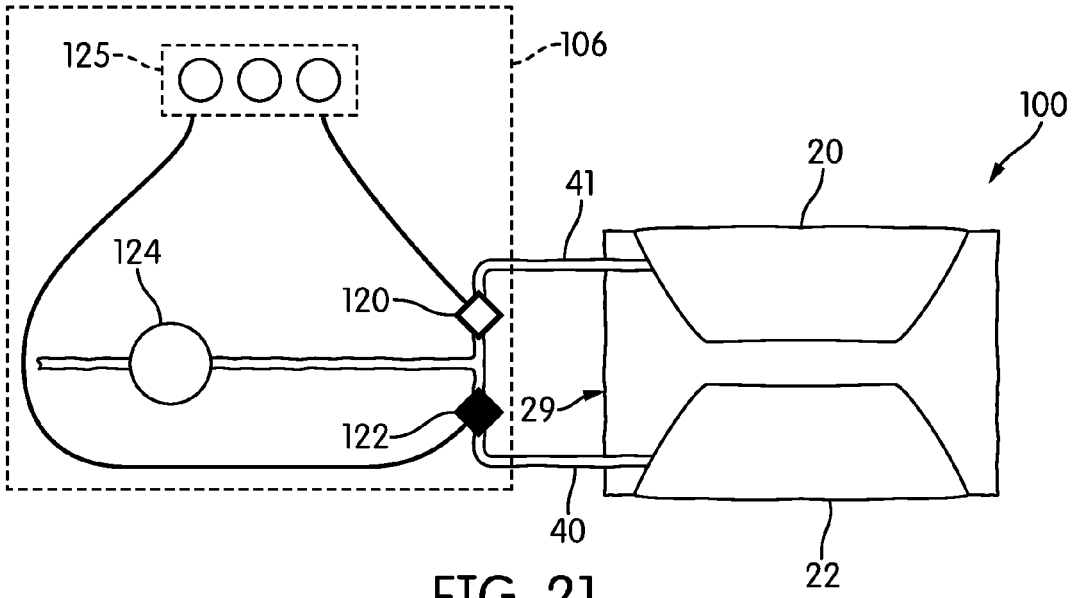
FIG. 21 is a schematic drawing where control switches are operatively connected to the left chamber air-supply valve (120) and the right chamber air-supply valve (122).
Figure 22:
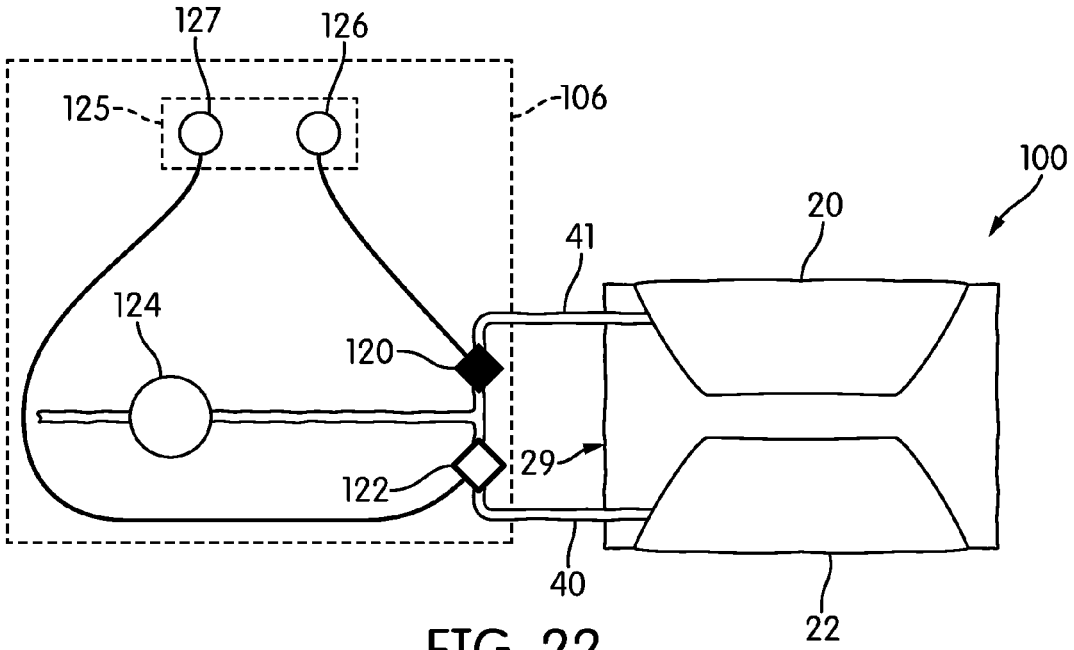
FIG. 22 is a schematic drawing where the left control switch (126) is operatively connected to the left chamber air-supply valve (120) and where the right control switch (127) is operatively connected to the right chamber air-supply valve (122).

Control switches (125) can be used to actuate the valves. FIG. 21 is a schematic drawing where control switches (125) are operatively connected to the left chamber air-supply valve (120) and the right chamber air-supply valve (122). For example, a left control switch (126) can actuate the left chamber air-supply valve (120) and a right control switch (127) can actuate the right chamber air-supply valve (122). FIG. 22 is a schematic drawing where the left control switch (126) is operatively connected to the left chamber air-supply valve (120) and where the right control switch (127) is operatively connected to the right chamber air-supply valve (122). The valves can be actuated independently or simultaneously. The left chamber air-supply valve (120) and the right chamber air-supply valve (122) may be combined into a single three way valve.

The air-supply hoses (104) are made of flexible material that won't kink while in use and are of such diameter to enable the air-supply system (106) to deliver enough air to maintain the right inflatable chamber (22), the left inflatable chamber (20) and inflatable positioning pad (102) in an inflated state.

To minimize air-hose entanglement, another embodiment further comprises manifolds attached to the base pad (23). These manifolds allow for the flow of air to the left inflatable chamber (20) and the right inflatable chamber (22). Because the manifolds are attached to the base pad (23), the manifolds are less prone to get entangled during patient shifting and turning. A left manifold (140) and a right manifold (150) are attached to the base pad (23), either at the head end of the tuning pad (28) or the foot end of the turning pad (29). The left manifold (140) and the right manifold (150) are made of a non air-permeable material that allows for the loss-less flow of air. A first end of the left manifold (142) is joined to the left inflatable chamber (20). A second end of the left manifold (144) is located on the edges of the turning pad (100) by the head end of the turning pad (28) or the foot end of the tuning pad (29). A left manifold in-flow connector (146) attaches to the second end of the left manifold (144). The second end of the left chamber air-hose (163) connects to the left manifold in-flow connector (146). A first end of the right manifold (152) is joined to the right inflatable chamber (22). A second end of the right manifold (154) is located on the edges of the turning pad (100 by the head end of the turning pad (28) or the foot end of the turning pad (29). A right manifold in-flow connector (156) attaches to the second end of the right manifold (154). The second end of right chamber air-hose (161) connects to the right manifold in-flow connector (156).

Figure 12:
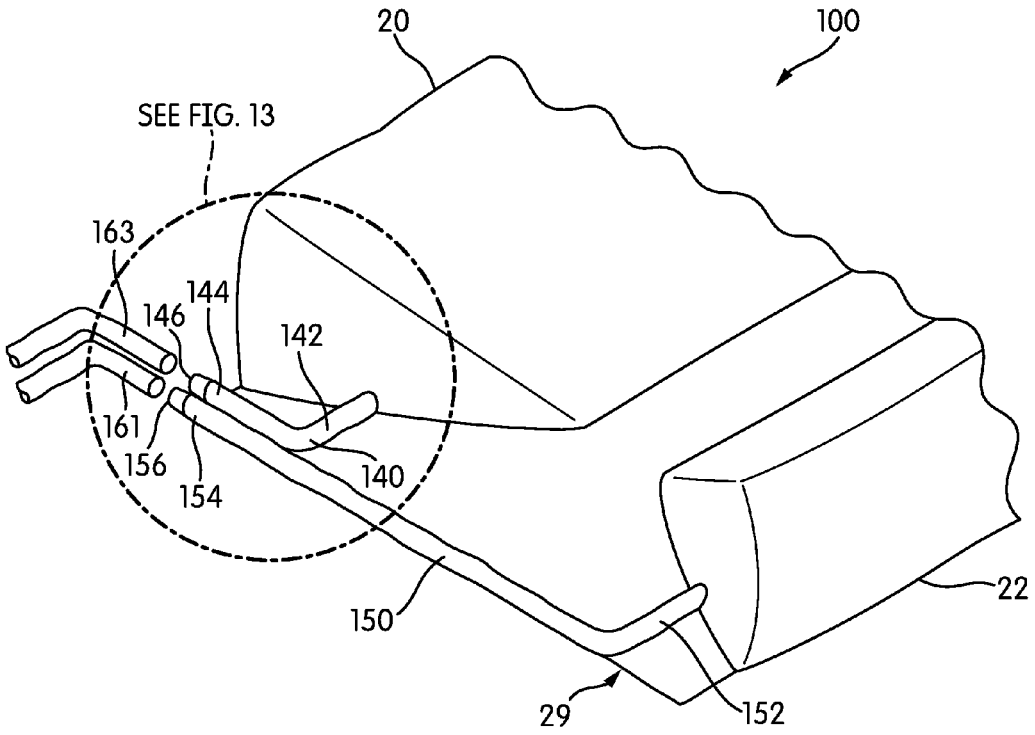
FIG. 12 is a perspective view of the foot end of the turning pad (29) where the left manifold (140) and the right manifold (150) are attached to the base pad (23) by the foot end of the turning pad (29). The first end of the left manifold (142) is joined to the left inflatable chamber (20) and the first end of the right manifold (152) is joined to the right inflatable chamber (22).
Figure 13:
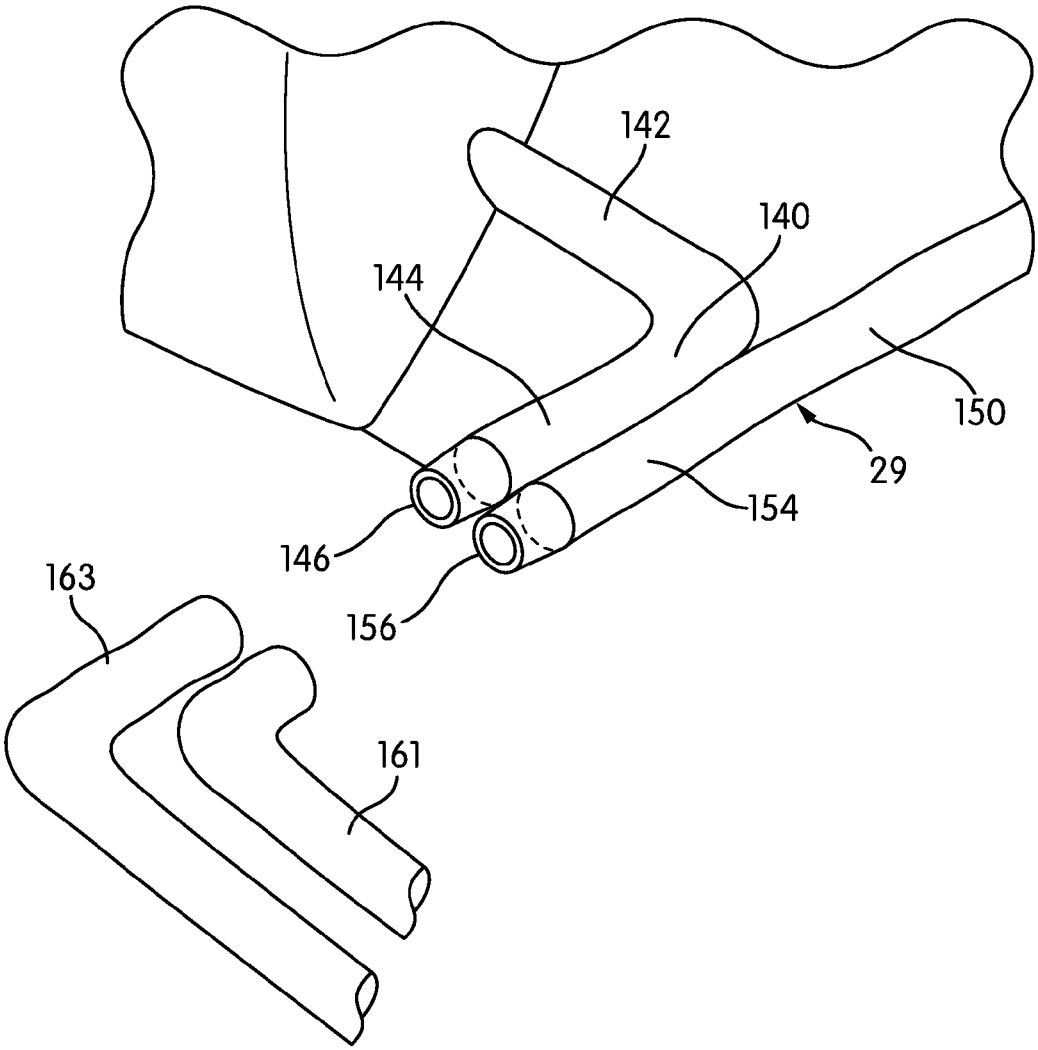
FIG. 13 is an enlarged view of the foot end of the turning pad (29) in FIG. 12, where the second end of the left manifold (144) and the second end of the right manifold (154) are placed side by side, allowing for the side-by-side placement of the left manifold in-flow connector (146) and the right manifold in-flow connector (156).

FIG. 12 is a perspective view of the foot end of the turning pad (29) where the left manifold (140) and the right manifold (150) are attached to the base pad (23) by the foot end of the turning pad (29). The first end of the left manifold (142) is joined to the left inflatable chamber (20) and the first end of the right manifold (152) is joined to the right inflatable chamber (22). In FIG. 12, the second end of the right manifold (154) and the second end of the left manifold (144) are located on the edges of the turning pad (100) by the foot end of the turning pad (29) by the left side of the turning pad (62). The second end of the left manifold (144) and the second end of the right manifold (154) are preferentially placed side-by-side. This side-by-side placement makes for an easier connection with the left chamber air-hose (41) and the right chamber air-hose (40). It also minimizes air-hose entanglement with a patient (108) and labor nurses during patient shifting and turning. FIG. 13 is an enlarged view of the foot end of the turning pad (29) in FIG. 12, where the second end of the left manifold (144) and the second end of the right manifold (154) are placed side by side, allowing for the side-by-side placement of the left manifold in-flow connector (146) and the right manifold in-flow connector (156).

Figure 14:
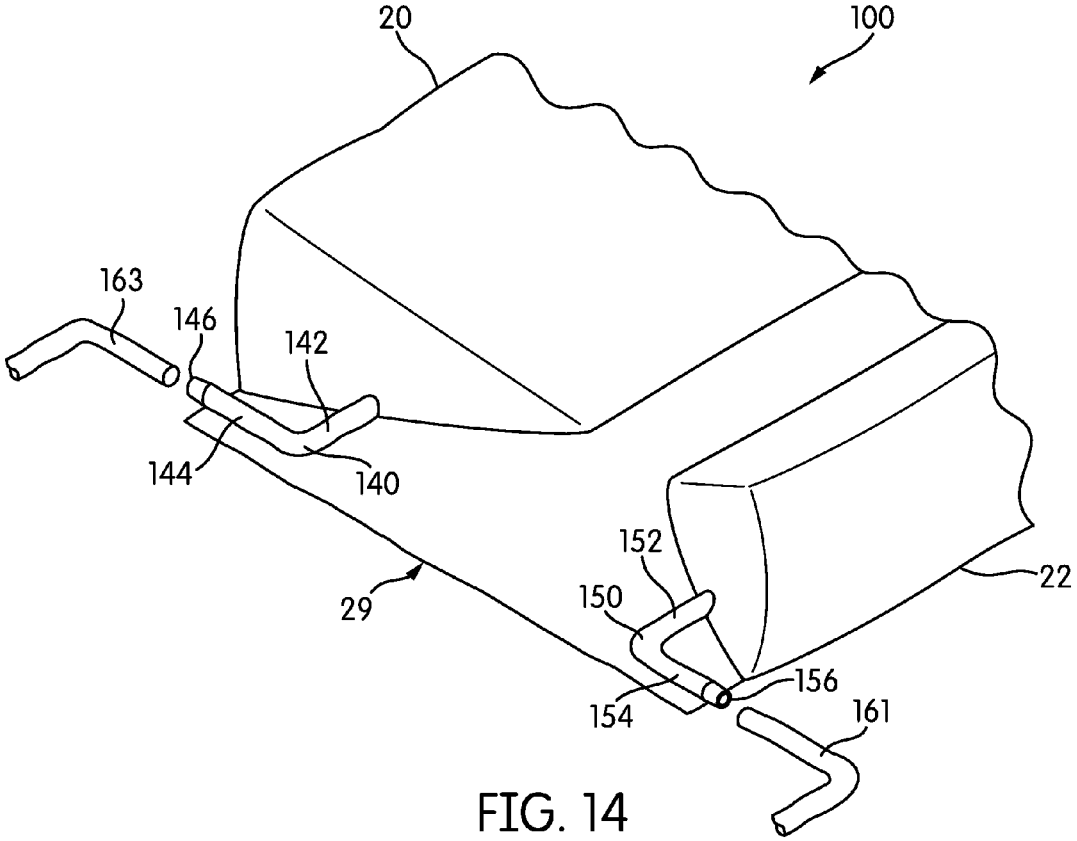
FIG. 14. is a perspective view of the foot end of the turning pad (29) where the second end of the right manifold (154) is located by the foot end of the turning pad (29) by the right side of the turning pad (63), and the second end of the left manifold is located by the foot end of the turning pad (29) by the left side of the turning pad (62).
Figure 15:
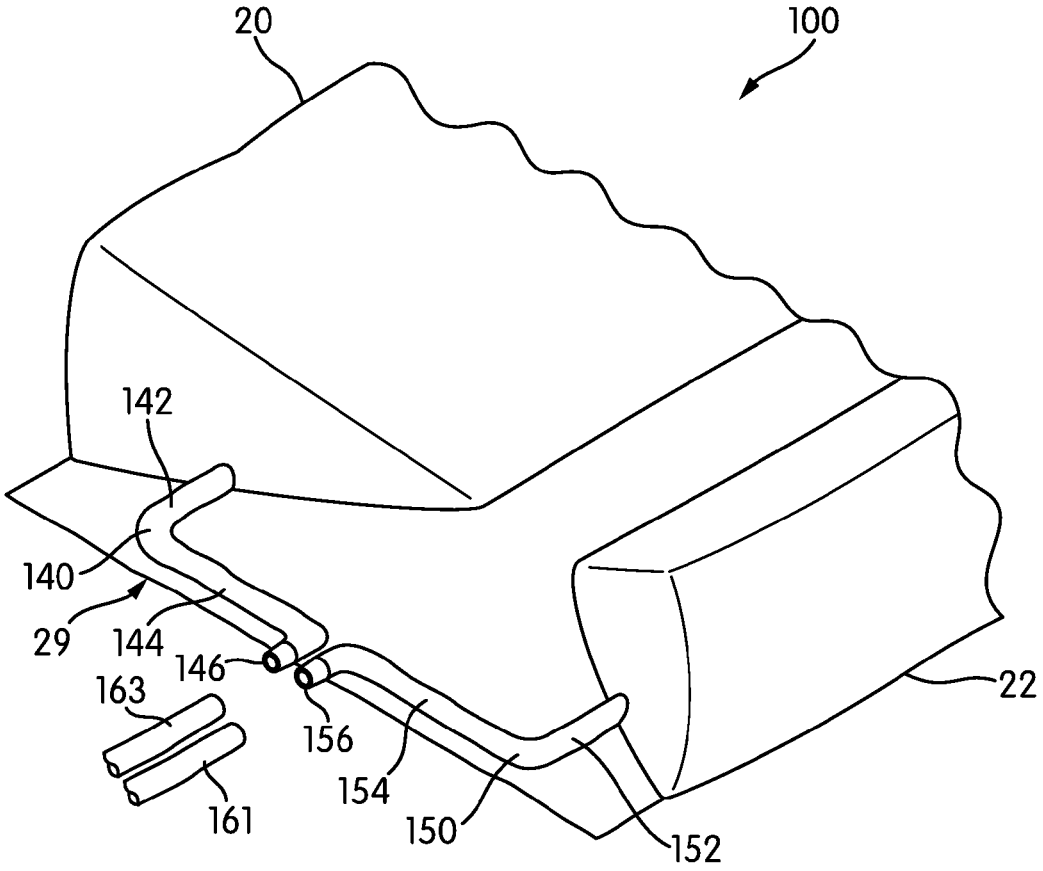
FIG. 15 is a perspective view of the foot end of the turning pad (29) where the second end of the right manifold (154) and the second end of the left manifold (144) are located by the foot end of the turning pad (29) by the center line of the turning pad (64).

The position of the second end of the right manifold and the second end of the left manifold can be changed within the base pad (23). FIG. 15 is a perspective view of the foot end of the turning pad (29) where the second end of the right manifold (154) and the second end of the left manifold (144) are located by the foot end of the turning pad (29) by the center line of the turning pad (64). FIG. 14. is a perspective view of the foot end of the turning pad (29) where the second end of the right manifold (154) is located by the foot end of the turning pad (29) by the right side of the turning pad (63), and the second end of the left manifold is located by the foot end of the turning pad (29) by the left side of the turning pad (62).

Figure 16:
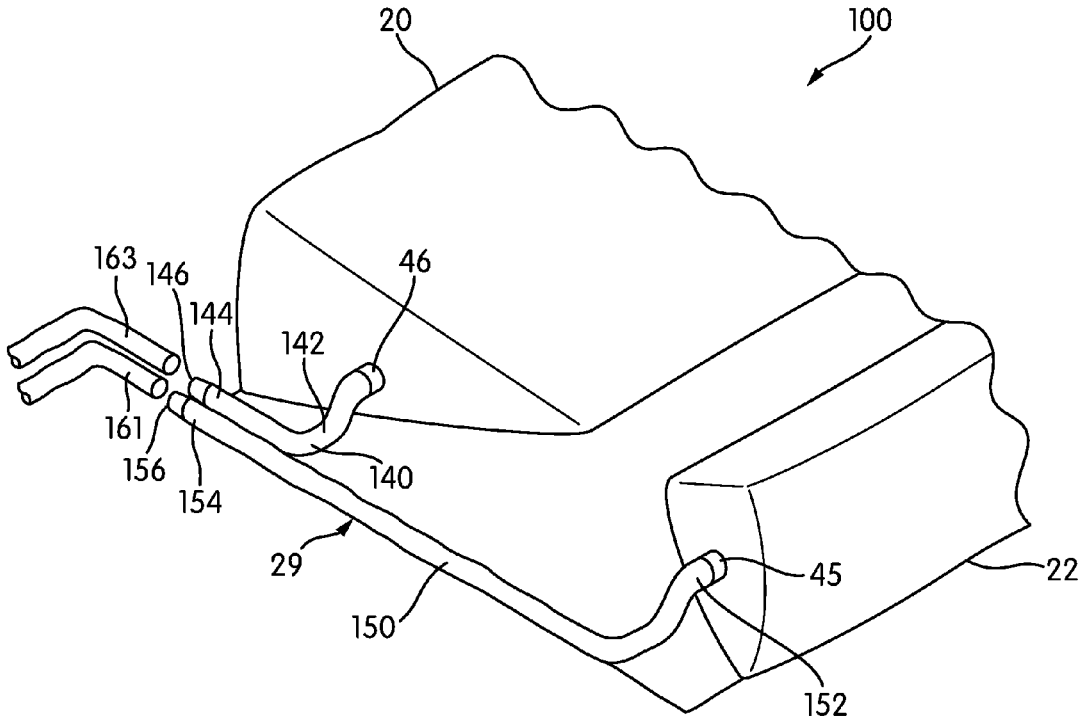
FIG. 16 is a perspective view of the foot end of the turning pad (29) where the left manifold (140) and the right manifold (150) are attached to the base pad (23). The first end of the left manifold (142) is connected to the left chamber connector (46) and the first end of the right manifold (152) is connected to the right chamber connector (45). A second end of the right manifold (144) is located by the foot end of the turning pad (29) by the left side of the turning pad (62). A second end of the left manifold (144) is located by the foot end of the turning pad (29) by the left side of the turning pad (62).

Another embodiment with manifolds comprises of a left manifold (140) and a right manifold (150) attached to the base pad (23), either by the head end of the turning pad (28) or at the foot end of the turning pad (29). The left manifold (140) and the right manifold (150) are made of a non-air permeable material that allows for the loss-less flow of air. A left chamber connector (46) is attached to the left inflatable chamber (20), and a right chamber connector (45) is attached to the right inflatable chamber (22). A first end of the left manifold (142) is connected to the left chamber connector (46). A second end of the left manifold (144) is located by the head end of the turning pad (28) or the foot end of the turning pad (29). A left manifold in-flow connector (146) attaches to the second end of the left manifold (144). The second end of the left chamber air-hose (163) connects to the left manifold in-flow connector (146). A right chamber connector (45) is attached to the right inflatable chamber (22). A first end of the right manifold (152) is connected to the right chamber connector (45). A second end of the right manifold (144) is located by the head end of the turning pad (28) or the foot end of the turning pad (29). A right manifold in-flow connector (156) attaches to the second end of the right manifold (154). The second end of the right chamber air-hose (161) connects to the right manifold in-flow connector (156). FIG. 16 is a perspective view of the foot end of the turning pad (29) where the left manifold (140) and the right manifold (150) are attached to the base pad (23) by the foot end of the turning pad (29). The first end of the left manifold (142) is connected to the left chamber connector (46) and the first end of the right manifold (152) is connected to the right chamber connector (45). A second end of the right manifold (144) is located by the foot end of the turning pad (29) by the left side of the turning pad (62). A second end of the left manifold (144) is located by the foot end of the turning pad (29) by the left side of the turning pad (62).

(3) Detailed Description of the Method Involving the Turning Device

A patient (108) is in right lateral position when the left side of her body is tilted up and the right side of her body leans against a surface. A patient (108) is in left lateral position when the right side of her body is tilted up and the left side of her body leans against a surface.

To turn a patient (108) to a right lateral position, the left inflatable chamber (20) needs to be in a deflated state and the right inflatable chamber (22) needs to be an inflated state. If the fabric material has air semi-permeable characteristics, the left inflatable chamber (20) can be deflated by reducing or stopping the air-supply coming from the air-supply system (106); the left inflatable chamber (20) will deflate rapidly and immediately due to the air semi-permeable nature of the fabric material. The deflation rate of the left inflatable chamber (20) can be increased by having a labor nurse open the left air-release valve (48) if one is attached to the left inflatable chamber (20). The deflation rate of the left inflatable chamber (20) can be increased by disconnecting the left chamber air-hose (41) from the left chamber connector (46).

The air-supply system (106) delivers air to the right inflatable chamber (22) as the left inflatable chamber (20) is deflating or once the left inflatable chamber (20) has stopped deflating. When the right inflatable chamber (22) has reached a semi inflated or an inflated state, a labor nurse, standing on the right side of the standard labor bed (as viewed from the foot end of the standard labor bed and turning pad (29)), pulls the inflatable positioning pad (102), preferably using the inflatable positioning pad's handles (30). This shifting motion will move a patient's body across the standard labor bed from the left side of the bed and turning pad (62) to the right side of the bed and turning pad (63) so that a patient's body leans over the slanted surface of the right inflatable chamber (22). If the right inflatable chamber (22) has not reached an inflated state by then, the right inflatable chamber (22) will continue to inflate, tilting a patient's body so that it ends up in a right lateral position. The inflatable positioning pad (102) is to remain located between a patient (108) and the turning pad (100). FIG. 18 is a sectional view of a patient (108) laying on her right side while the right inflatable chamber (22) is inflated and the left inflatable chamber (20) is deflated, as viewed from the foot end of the turning pad (29). The inflatable positioning pad (102) lies between a patient (108) and the turning pad (100). FIG. 3 shows the relative locations of the turning pad (100): a head end (28), a foot end (29), a left side (62), a right side (63), and a center line (64).

To turn a patient (108) to a left lateral position, the right inflatable chamber (22) needs to be in a deflated state and the left inflatable chamber (20) needs to be in an inflated state. If the fabric material has air semi-permeable characteristics, the right inflatable chamber (22) can be deflated by reducing or stopping the air-supply coming from the air-supply system (106); the right inflatable chamber (22) will deflate rapidly and immediately due to the air semi-permeable nature of the fabric material. The deflation rate of the right inflatable chamber (22) can be increased by having a labor nurse open the right air-release valve (49) if one is attached to the right inflatable chamber (22). The deflation rate of the right inflatable chamber (22) can be increased by disconnecting the right chamber air-hose (40) from the right chamber connector (45).

The air-supply system (106) supplies air to the left inflatable chamber (20) as the right inflatable chamber (22) is deflating or once the right inflatable chamber (22) has stopped deflating. When the left inflatable chamber (20) has reached a semi inflated or inflated state, a labor nurse, standing on the left side of the standard labor bed, pulls the inflatable positioning pad (102), preferably using the inflatable positioning pad's handles (30). This shifting motion will move a patient's body across the standard labor bed from the right side of the bed and turning pad (63) to the left side of the bed and turning pad (62) so that a patient's body leans over the slanted surface of the left inflatable chamber (20). If the left inflatable chamber (20) has not reached an inflated state by then, the left inflatable chamber (20) will continue to inflate, tilting a patient's body so that it ends up in a left lateral position. The inflatable positioning pad (102) is to remain located between a patient (108) and the turning pad (100). FIG. 17 is a sectional view of a patient (108) laying on her left side while the left inflatable chamber (20) is inflated and the right inflatable chamber (22) is deflated, as viewed from the foot end of the turning pad (29). The inflatable positioning pad (102) lies between a patient (108) and the turning pad (100).

There are numerous advantages to this method of turning a patient utilizing the turning device. First, the method allows for rapid deflation and inflation of air chambers. Second, the method allows for rapid shifting of a patient from one side of the bed to the other side of the bed. Third, the method allows for rapid turning of a patient from one lateral side to another lateral side. Fourth, the method allows for a patient's body to be positioned over a slanted supporting surface, allowing the body to inclined at a steep angle. Fifth, being able to easily move a patient's body from one side of the bed to the other, allows for more bed area space in front of a patient's body, useful for a patient to place objects such as books and food or for the labor nurse to place medical instruments or other supplies.

If desired, the labor nurse can use the inflatable positioning pad (102) to hold a patient (108) in position while the air-supply to either the left inflatable chamber (20) or the right inflatable chamber (22) is shut off and pillows are used to prop up a patient (108) and to place a patient (108) in a desired body position, such as, in preparation for vaginal delivery.

The inflatable positioning pad (102) can be used to shift a patient's body within the bed. For example, if at the time of expected vaginal delivery, a patient (108) is not in the desired body position, the labor nurse can pull the inflatable positioning pad (102) and shift a patient to the recommended position on the bed. This shifting can be accomplished with the inflatable positioning pad (102) either inflated or deflated, using or not using the handles (30). After end of the labor bed has been removed, a labor nurse can use the handles (30) of the inflatable positioning pad (102) to shift a patient (108) down to the location she prefers with little other assistance.

Figure 27:
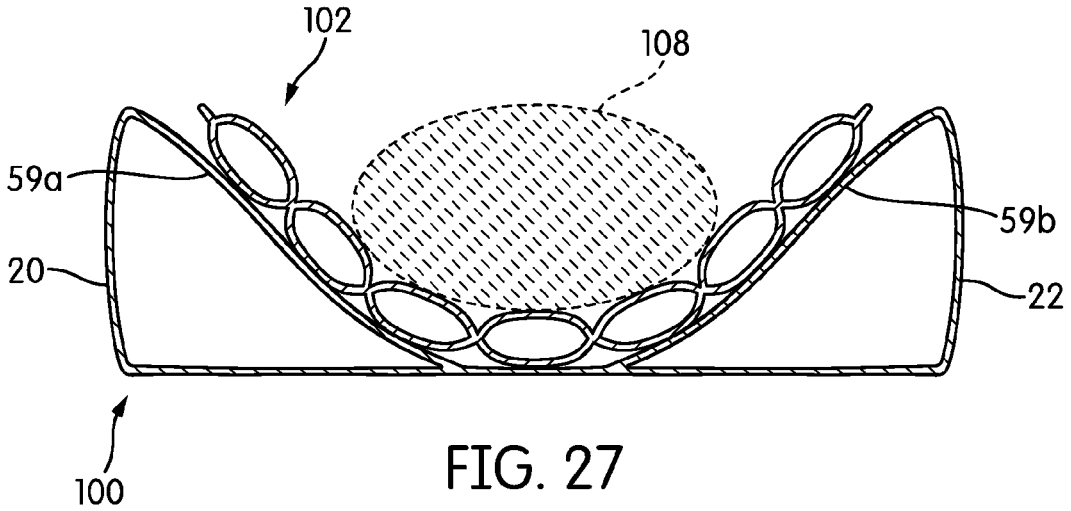
FIG. 27 is a sectional view of a patient (108) laying on a level position, where the left inflatable chamber (20), the right inflatable chamber (22) and the inflatable positioning pad (102) are inflated simultaneously. The inflatable positioning pad (102) lies between a patient (108) and the turning pad (100).

A patient (108) can also be placed in a level position, where the left inflatable chamber (20), the right inflatable chamber (22) and the inflatable positioning pad (102) are inflated simultaneously. A patient (108) lies between the inflated left inflatable chamber (20) and the inflated right inflatable chamber (22) and lies over the inflatable positioning pad (102). The patient lies over the turning pad (100) at the turning pad's center line (64). FIG. 1. shows the turning pad (100) with the left inflatable chamber (20) and the right inflatable chamber (22) inflated simultaneously. FIG. 27 is a sectional view of a patient (108) laying on a level position, where the left inflatable chamber (20), the right inflatable chamber (22) and the inflatable positioning pad (102) are inflated simultaneously. The inflatable positioning pad (102) lies between a patient (108) and the turning pad (100).

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

We claim:

1. An apparatus for turning and shifting a patient, which comprises:

a.) an inflatable positioning pad connector;

b.) a plurality of handles;

c.) a turning pad, which comprises:

i.) a left inflatable chamber, which comprises: left chamber support structures; and a left chamber inside surface; where the left chamber support structures are fastened to the left chamber inside surface;

ii.) a right inflatable chamber, which comprises: right chamber support structures; and a right chamber inside surface; where the right chamber support structures are fastened to the right chamber inside surface;

iii.) a left chamber connector;

iv.) a right chamber connector;

v.) a base pad, which comprises: a base sheet;

vi.) where the right inflatable chamber and the left inflatable chamber are fastened to the base pad, vii.) where the left chamber connector is attached to the left inflatable chamber, and viii.) where the right chamber connector is attached to the right inflatable chamber;

d.) an inflatable positioning pad, which comprises:

i.) a plurality of seams;

ii.) a top surface;

iii.) a bottom surface;

iv.) where the top surface and the bottom surface are joined at the seams, v.) where the inflatable positioning pad connector is attached to the inflatable positioning pad, vi.) where the handles are attached to the inflatable positioning pad;

e.) an air-supply system, which comprises:

i.) a left chamber air-supply valve;

ii.) a right chamber air-supply valve;

iii.) an air source; where the air source is connected to the left chamber air-supply valve to supply air to the left inflatable chamber, where the air source is connected to the right chamber air-supply valve to supply air to the right inflatable chamber, and where the air source supplies air to the inflatable positioning pad;

f.) air-supply hoses, which comprise:

i.) a right chamber air-hose, which comprises: a first end; and a second end; where the first end of the right chamber air-hose is connected to the air-supply system and the second end of the right chamber air-hose is connected to the right chamber connector;

ii.) a left chamber air-hose, which comprises: a first end; and a second end; where the first end of the left chamber air-hose is connected to the air-supply system and the second end of the left chamber air-hose is connected to the left chamber connector; and iii.) an inflatable positioning pad air-hose, which comprises: a first end; and a second end; where the first end of the inflatable positioning pad air-hose is connected to the air-supply system, and the second end of the inflatable positioning pad air-hose is connected to the inflatable positioning pad connector;

g.) where the inflatable positioning pad lies over the turning pad, and h.) where the inflatable positioning pad lies under a patient.

2. The apparatus for turning and shifting a patient according to claim 1, wherein the inflatable positioning pad and the turning pad are made of semi air-permeable material.

3. The apparatus for turning and shifting a patient according to claim 2, a.) wherein the turning pad, further comprising: a right air-release valve; where the right air-release valve is attached to the right inflatable chamber; and b.) wherein the turning pad, further comprising: a left air-release valve; where the left air-release valve is attached to the left inflatable chamber.

4. The apparatus for turning and shifting a patient according to claim 3, wherein the left inflatable chamber further comprising: a left chamber slanted support surface; and wherein the right inflatable chamber further comprising: a right chamber slanted support surface.

5. The apparatus for turning and shifting a patient according to claim 4, the apparatus further comprising:

a.) a turning pad sheath; and an inflatable positioning pad sheath;

b.) where the turning pad sheath covers the turning pad, and the inflatable positioning pad sheath covers the inflatable positioning pad.

6. A method for turning a patient using the apparatus according to claim 3, comprising the steps of:

a.) turning the patient to a left lateral position, comprising the steps of:

i.) closing the right chamber air-supply valve;

ii.) opening the left chamber air-supply valve;

iii.) shifting the inflatable positioning pad from the right side of the turning pad to the left side of the turning pad to a point where the patient lies against the left inflatable chamber;

b.) turning the patient to a right lateral position, comprising the steps of:

i.) closing the left chamber air-supply valve;

ii.) opening the right chamber air-supply valve;

iii.) shifting the inflatable positioning pad from the left side of the turning pad to the right side of the turning pad to a point where the patient lies flat against the right inflatable chamber.

7. The method for turning a patient using the apparatus according to claim 6, further comprising the step of: maintaining the patient in a level position, which comprises the steps of:

a.) shifting the inflatable positioning pad to the center of the turning pad;

b.) opening the right chamber air-supply valve;

c.) opening the left chamber air-supply valve.

8. The method for turning a patient using the apparatus according to claim 6, a.) wherein the step of turning the patient to a left lateral position further comprising the steps of:

i.) opening the right air-release valve prior to step (i);

ii.) closing the left air-release valve prior to step (ii);

b.) wherein the step of turning the patient to a right lateral position further comprising the steps of:

i.) opening the left air-release valve prior to step (i);

ii.) closing the right air-release valve prior to step (ii).

9. The method for turning a patient using the apparatus according to claim 6, a.) wherein the step of turning the patient to a left lateral position further comprising the step of:

i.) grabbing the handles of the inflatable positioning pad prior to step (iii);

b.) wherein the step of turning the patient to a right lateral position further comprising the step of:

i.) grabbing the handles of the inflatable positioning pad prior to step (iii).

10. The apparatus for turning and shifting a patient according to claim 1, a.) wherein the air-supply system further comprising: a plurality of control switches;

b.) where the plurality of control switches is operatively connected to the left chamber air-supply valve and the right chamber air-supply valve.

11. The apparatus for turning and shifting a patient according to claim 10, a.) wherein the plurality of control switches comprises: a left control switch; and a right control switch;

b.) where the left control switch is operatively connected to the left chamber air-supply valve, and c.) where the right control switch is operatively connected to the right chamber air-supply valve.

12. The apparatus for turning and shifting a patient to according to claim 1, a.) wherein the turning pad, further comprising: a right air-release valve; where the right air-release valve is attached to the right inflatable chamber; and b.) wherein the turning pad, further comprising: a left air-release valve; where the left air-release valve is attached to the left inflatable chamber.

13. The apparatus for turning and shifting a patient according to claim 1, the apparatus further comprising:

a.) a turning pad sheath; and an inflatable positioning pad sheath;

b.) where the turning pad sheath covers the turning pad, and the inflatable positioning pad sheath covers the inflatable positioning pad.

14. The apparatus for turning and shifting a patient according to claim 1, wherein the left inflatable chamber further comprising: a left chamber slanted support surface; and wherein the right inflatable chamber further comprising: a right chamber slanted support surface.

15. The apparatus for turning and shifting a patient according to claim 14, wherein the left inflatable chamber is shaped like a wedge, and wherein the right inflatable chamber is shaped like a wedge.

16. A device for turning and shifting a patient, which comprises:

a.) an inflatable positioning pad connector;

b.) a plurality of handles;

c.) a turning pad, which comprises:

i.) a left inflatable chamber, which comprises: left chamber support structures; and a left chamber inside surface; where the left chamber support structures are fastened to the left chamber inside surface;

ii.) a right inflatable chamber, which comprises: right chamber support structures; and a right chamber inside surface; where the right chamber support structures are fastened to the right chamber inside surface;

iii.) a left chamber connector;

iv.) a right chamber connector;

v.) a base pad which comprises: a left securing sleeve; a right securing sleeve; a base sheet; and where the right securing sleeve and the left securing sleeve are fastened to the base sheet;

vi.) where the left chamber connector is attached to the left inflatable chamber, and vii.) where the right chamber connector is attached to the right inflatable chamber;

d.) an inflatable positioning pad, which comprises:

i.) a plurality of seams;

ii.) a top surface;

iii.) a bottom surface;

iv.) where the top surface and the bottom surface are joined at the seams, v.) where the inflatable positioning pad connector is attached to the inflatable positioning pad, and vi.) where the handles are attached to the inflatable positioning pad;

e.) an air-supply system, which comprises:

i.) a left chamber air-supply valve;

ii.) a right chamber air-supply valve;

iii.) an air source; where the air source is connected to the left chamber air-supply valve to supply air to the left inflatable chamber, where the air source is connected to the right chamber air-supply valve to supply the air to the right inflatable chamber, and where the air source supplies the air to the inflatable positioning pad;

f.) air-supply hoses, which comprise:

i.) a right chamber air-hose, which comprises: a first end and a second end; where the first end of the right chamber air-hose is connected to the air-supply system and the second end of the right chamber air-hose is connected to the right chamber connector;

ii.) a left chamber air-hose, which comprises: a first end and a second end; where the first end of the left chamber air-hose is connected to the air-supply system and the second end of the left chamber air-hose is connected to the left chamber connector; and iii.) an inflatable positioning pad air-hose, which comprises: a first end; and a second end; where the first end of the inflatable positioning pad air-hose is connected to the air-supply system and the second end of the inflatable positioning pad air-hose is connected to the inflatable positioning pad connector;

g.) where the left inflatable chamber is inserted within the left securing sleeve, h.) where the right inflatable chamber is inserted within the right securing sleeve, i.) where the inflatable positioning pad lies over the turning pad, j.) where the inflatable positioning pad lies under a patient.

17. The device for turning and shifting a patient according to claim 16, a.) wherein the turning pad, further comprising: a right air-release valve; where the right air-release valve is attached to the right inflatable chamber; and b.) wherein the turning pad, further comprising: a left air-release valve; where the left air-release valve is attached to the left inflatable chamber.

18. The device for turning and shifting a patient according to claim 16, wherein the left inflatable chamber further comprising: a left chamber slanted support surface; and wherein the right inflatable chamber further comprising: a right chamber slanted support surface.

19. The device for turning and shifting a patient according to claim 18, wherein the left inflatable chamber is shaped like a wedge, and wherein the right inflatable chamber is shaped like a wedge.

20. The device for turning and shifting a patient according to claim 16, the device further comprising:

a.) a turning pad sheath; and an inflatable positioning pad sheath;

b.) where the turning pad sheath covers the turning pad, and the inflatable positioning pad sheath covers the inflatable positioning pad.

21. The device for turning and shifting a patient according to claim 16, a.) wherein the air-supply system further comprising: a plurality of control switches;

b.) where the plurality of control switches is operatively connected to the left chamber air-supply valve and the right chamber air-supply valve.

22. The device for turning and shifting a patient according to claim 21, a.) wherein the plurality of control switches comprises: a left control switch; and a right control switch;

b.) where the left control switch is operatively connected to the left chamber air-supply valve, and c.) where the right control switch is operatively connected to the right chamber air-supply valve.

23. The device for turning and shifting a patient according to claim 16, wherein the inflatable positioning pad and the turning pad are made of semi air-permeable material.

24. The device for turning and shifting a patient according to claim 23, a.) wherein the turning pad, further comprising: a right air-release valve; where the right air-release valve is attached to the right inflatable chamber; and b.) wherein the turning pad, further comprising: a left air-release valve; where the left air-release valve is attached to the left inflatable chamber.

25. The device for turning and shifting a patient according to claim 24, wherein the left inflatable chamber further comprising: a left chamber slanted support surface; and wherein the right inflatable chamber further comprising: a right chamber slanted support surface.

26. The device for turning and shifting a patient according to claim 25, the device further comprising:

a.) a turning pad sheath; and an inflatable positioning pad sheath;

b.) where the turning pad sheath covers the turning pad, and the inflatable positioning pad sheath covers the inflatable positioning pad.

27. A method for turning a patient using the device according to claim 24, which comprises:

a.) turning the patient to a left lateral position, which comprises:

i.) closing the right chamber air-supply valve;

ii.) opening the left chamber air-supply valve;

iii.) shifting the inflatable positioning pad from the right side of the turning pad to the left side of the turning pad to a point where the patient lies flat against the left inflatable chamber;

b.) turning the patient to a right lateral position, which comprises:

i.) closing the left chamber air-supply valve;

ii.) opening the right chamber air-supply valve;

iii.) shifting the inflatable positioning pad from the left side of the turning pad to the right side of the turning pad to a point where the patient lies flat against the right inflatable chamber.

28. The method for turning a patient using the device according to claim 27, further comprising a step of: maintaining the patient in a level position, which comprises the steps of:

a.) shifting the inflatable positioning pad to the center of the turning pad;

b.) opening the right chamber air-supply valve;

c.) opening the left chamber air-supply valve.

29. The method for turning a patient using the device according to claim 27, a.) wherein the step of turning the patient to a left lateral position further comprising the steps of:

i.) opening the right air-release valve prior to step (i);

ii.) closing the left air-release valve prior to step (ii);

b.) wherein the step of turning the patient to a right lateral position further comprising the steps of:

i.) opening the left air-release valve prior to step (i);

ii.) closing the right air-release valve prior to step (ii).

30. The method for turning a patient using the device according to claim 27, a.) wherein the step of turning the patient to a left lateral position further comprising the step of:

i.) grabbing the handles of the inflatable positioning pad prior to step (iii);

b.) wherein the step of turning the patient to a right lateral position further comprising the step of:

i.) grabbing the handles of the inflatable positioning pad prior to step (iii).

31. A machine for turning and shifting a patient, which comprises:

a.) an inflatable positioning pad connector;

b.) a plurality of handles;

c.) a turning pad, which comprises:

i.) a left inflatable chamber, which comprises: left chamber support structures; and a left chamber inside surface; where the left chamber support structures are fastened to the left chamber inside surface;

ii.) a right inflatable chamber, which comprises, right chamber support structures; and a right chamber inside surface; where the right chamber support structures are fastened to the right chamber inside surface;

iii.) a left manifold, which comprises: a left manifold in-flow connector; a first end; and a second end; where the left manifold in-flow connector is attached to the second end of the left manifold;

iv.) a right manifold, which comprises: a right manifold in-flow connector; a first end; and a second end; where the right manifold in-flow connector is attached to the second end of the right manifold;

v.) a base pad, which comprises: a base sheet;

vi.) where the left manifold is attached to the base pad, and the right manifold is attached to the base pad, vii.) where the right inflatable chamber and the left inflatable chamber are fastened to the base pad;

d.) an inflatable positioning pad, which comprises:

i.) a plurality of seams;

ii.) a top surface;

iii.) a bottom surface;

iv.) where the top surface and the bottom surface are joined at the seams, v.) where the inflatable positioning pad connector is attached to the inflatable positioning pad, and vi.) where the handles are attached to the inflatable positioning pad;

e.) an air-supply system, which comprises:

i.) a left chamber air-supply valve;

ii.) a right chamber air-supply valve;

iii.) an air source; where the air source is connected to the left chamber air-supply valve to supply air to the left inflatable chamber, where the air source is connected to the right chamber air-supply valve to supply the air to the right inflatable chamber, and where the air source supplies the air to the inflatable positioning pad;

f.) air-supply hoses, which comprise:

i.) a right chamber air-hose, which comprises, a first end; a second end; and a right manifold in-flow connector; where the first end of the right chamber air-hose is connected to the air-supply system and the second end of the right chamber air-hose is connected to the right manifold in-flow connector, ii.) a left chamber air-hose, which comprises: a first end; a second end; and a left manifold in-flow connector; where the first end of the left chamber air-hose is connected to the air-supply system, and the second end of the left chamber air-hose is connected to the left manifold in-flow connector;

iii.) an inflatable positioning pad air-hose, which comprises: a first end; and a second end; where the first end of the inflatable positioning pad air-hose is connected to the air-supply system and the second end of the inflatable positioning pad is connected to the inflatable positioning pad connector;

g.) where the inflatable positioning pad lies over the turning pad, h.) where the inflatable positioning pad lies under a patient.

32. The machine for turning and shifting a patient according to claim 31, further comprising: a left chamber connector; and a right chamber connector;

a.) where the left chamber connector is attached to the left inflatable chamber, and the right chamber connector is attached to the right inflatable chamber, and b.) where the first end of the left manifold is connected to the left chamber connector, and the first end of the right manifold is connected to the right chamber connector.

33. The machine for turning and shifting a patient according to claim 32, the machine further comprising: a turning pad sheath and an inflatable positioning pad sheath, where the turning pad sheath covers the turning pad, and the inflatable positioning pad sheath covers the inflatable positioning pad.

34. The machine for turning and shifting a patient according to claim 32, wherein the air-supply system further comprising: a plurality of control switches, where the plurality of control switches are operatively connected to the left chamber air-supply valve and the right chamber air-supply valve.

35. The machine for turning and shifting a patient according to claim 34, wherein the plurality of control switches is comprised of a left control switch; and a right control switch; where the left control switch is operatively connected to the left chamber air-supply valve, and where the right control switch is operatively connected to the right chamber air-supply valve.

36. The machine for turning and shifting a patient according to claim 35, wherein the inflatable positioning pad, the left inflatable chamber, the right inflatable chamber, and the base pad are made of semi air-permeable material, and wherein the right manifold and the left manifold are made of non air-permeable material.

37. The machine for turning and shifting a patient according to claim 36, a.) wherein the turning pad, further comprising: a right air-release valve; where the right air-release valve is attached to the right inflatable chamber; and b.) wherein the turning pad, further comprising: a left air-release valve; where the left air-release valve is attached to the left inflatable chamber.

38. The machine for turning and shifting a patient according to claim 37, wherein the left inflatable chamber further comprising: a left chamber slanted support surface; and wherein the right inflatable chamber further comprising: a right chamber slanted support surface.

39. The machine for turning and shifting a patient according to claim 38, the machine further comprising: a turning pad sheath; and an inflatable positioning pad sheath; where the turning pad sheath covers the turning pad, and the inflatable positioning pad sheath covers the inflatable positioning pad.

40. The machine for turning and shifting a patient according to claim 35, a.) wherein the turning pad, further comprising: a right air-release valve; where the right air-release valve is attached to the right inflatable chamber; and b.) wherein the turning pad, further comprising: a left air-release valve; where the left air-release valve is attached to the left inflatable chamber.

41. The machine for turning and shifting a patient according to claim 35, wherein the left inflatable chamber further comprising: a left chamber slanted support surface; and wherein the right inflatable chamber further comprising: a right chamber slanted support surface.

42. The machine for turning and shifting a patient according to claim 41, a.) wherein the turning pad, further comprising: a right air-release valve; where the right air-release valve is attached to the right inflatable chamber; and b.) wherein the turning pad, further comprising: a left air-release valve; where the left air-release valve is attached to the left inflatable chamber.

43. The machine for turning and shifting a patient according to claim 31, where the first end of the left manifold is joined to the left inflatable chamber, and the first end of the right manifold is joined to the right inflatable chamber.

44. The machine for turning and shifting a patient according to claim 43, wherein the inflatable positioning pad, the left inflatable chamber, the right inflatable chamber, and the base pad are made of semi air-permeable material, and wherein the right manifold and the left manifold are made of non air-permeable material.

45. The machine for turning and shifting a patient according to claim 44, a.) wherein the turning pad, further comprising: a right air-release valve; where the right air-release valve is attached to the right inflatable chamber; and b.) wherein the turning pad, further comprising: a left air-release valve; where the left air-release valve is attached to the left inflatable chamber.

46. The machine for turning and shifting a patient according to claim 45, wherein the left inflatable chamber further comprising: a left chamber slanted support surface; and wherein the right inflatable chamber further comprising: a right chamber slanted support surface.

47. The machine for turning and shifting a patient according to claim 46, the machine further comprising: a turning pad sheath; and an inflatable positioning pad sheath; where the turning pad sheath covers the turning pad and the inflatable positioning pad sheath covers the inflatable positioning pad.

48. The machine for turning and shifting a patient according to claim 43, a.) wherein the turning pad, further comprising: a right air-release valve; where the right air-release valve is attached to the right inflatable chamber; and b.) wherein the turning pad, further comprising: a left air-release valve; where the left air-release valve is attached to the left inflatable chamber.

49. The machine for turning and shifting a patient according to claim 43, wherein the left inflatable chamber further comprising: a left chamber slanted support surface; and wherein the right inflatable chamber further comprising: a right chamber slanted support surface.

50. The machine for turning and shifting a patient according to claim 49, wherein the left inflatable chamber is shaped like a wedge, and wherein the right inflatable chamber is shaped like a wedge.

51. The machine for turning and shifting a patient according to claim 43, the machine further comprising: a turning pad sheath; and an inflatable positioning pad sheath; where the turning pad sheath covers the turning pad, and the inflatable positioning pad sheath covers the inflatable positioning pad.

52. The machine for turning and shifting a patient according to claim 43, wherein the air-supply system further comprising: a plurality of control switches, where the plurality of control switches are operatively connected to the left chamber air-supply valve and the right chamber air-supply valve.

53. The machine for turning and shifting a patient according to claim 52, wherein the plurality of control switches is comprised of a left control switch; and a right control switch; where the left control switch is operatively connected to the left chamber air-supply valve, and where the right control switch is operatively connected to the right chamber air-supply valve.

* * * * *